US012091921B2

(12) United States Patent
Kulke et al.

(10) Patent No.: US 12,091,921 B2
(45) Date of Patent: Sep. 17, 2024

(54) SHOCK-BASED DAMPING SYSTEMS AND MECHANISMS FOR VIBRATION DAMPING IN DOWNHOLE APPLICATIONS

(71) Applicants: Vincent Kulke, Lower-Saxony (DE); Georg-Peter Ostermeyer, Braunschweig (DE); Andreas Hohl, Hannover (DE); Hanno Reckmann, Nienhagen (DE); Armin Kueck, Bremen (DE)

(72) Inventors: Vincent Kulke, Lower-Saxony (DE); Georg-Peter Ostermeyer, Braunschweig (DE); Andreas Hohl, Hannover (DE); Hanno Reckmann, Nienhagen (DE); Armin Kueck, Bremen (DE)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 40 days.

(21) Appl. No.: 17/859,197

(22) Filed: Jul. 7, 2022

(65) Prior Publication Data

US 2023/0009235 A1 Jan. 12, 2023

Related U.S. Application Data

(60) Provisional application No. 63/220,624, filed on Jul. 12, 2021.

(51) Int. Cl.
*E21B 17/07* (2006.01)

(52) U.S. Cl.
CPC ..... *E21B 17/07* (2013.01)

(58) Field of Classification Search
CPC ..... E21B 17/07
See application file for complete search history.

(56) References Cited

U.S. PATENT DOCUMENTS

| | | | | |
|---|---|---|---|---|
| 6,098,726 | A | 8/2000 | Taylor et al. | |
| 6,189,610 | B1 * | 2/2001 | LaClare | E21B 23/01 166/208 |
| 2016/0305197 | A1 | 10/2016 | Gajji et al. | |
| 2019/0284881 | A1 | 9/2019 | Hohl et al. | |
| 2020/0018377 | A1 | 1/2020 | Hohl et al. | |
| 2021/0079976 | A1 | 3/2021 | Hohl et al. | |

FOREIGN PATENT DOCUMENTS

| | | | |
|---|---|---|---|
| WO | 2009030925 | A2 | 3/2009 |

OTHER PUBLICATIONS

International Search Report and Written Opinion for International Application No. PCT/US2022/036357; Date of Search: Oct. 25, 2022; 8 pages.

* cited by examiner

*Primary Examiner* — Tara Schimpf
*Assistant Examiner* — Lamia Quaim
(74) *Attorney, Agent, or Firm* — CANTOR COLBURN LLP

(57) ABSTRACT

Systems and methods for damping vibrations of downhole systems are described. The systems include a downhole component configured to be disposed downhole and a shock-damping system at least one of on or in the downhole component, the shock-damping system configured to reduce torsional oscillations of the downhole component by imparting a selected shock to the downhole component. The selected shock is selected to generate damping of the torsional oscillations of the downhole system.

24 Claims, 16 Drawing Sheets

SHOCK-BASED DAMPING SYSTEMS AND MECHANISMS FOR VIBRATION DAMPING IN DOWNHOLE APPLICATIONS

CROSS REFERENCE TO RELATED APPLICATIONS

This application claims the benefit of an earlier filing date from U.S. Provisional Application Ser. No. 63/220,624 filed Jul. 12, 2021, the entire disclosure of which is incorporated herein by reference.

BACKGROUND

1. Field of the Invention

The present invention generally relates to downhole operations and systems for damping vibrations of the downhole systems during operation.

2. Description of the Related Art

Boreholes are drilled deep into the earth for many applications such as carbon dioxide sequestration, geothermal production, and hydrocarbon exploration and production. In all of the applications, the boreholes are drilled such that they pass through or allow access to a material (e.g., a gas or fluid) contained in a formation (e.g., a compartment) located below the earth's surface. Different types of tools and instruments may be disposed in the boreholes to perform various tasks and measurements.

In operation, the downhole components may be subject to vibrations that can impact operational efficiencies. For example, severe vibrations in drill strings and bottomhole assemblies can be caused by cutting forces at the bit or mass imbalances in downhole tools such as mud motors. Impacts from such vibrations can include, but are not limited to, reduced rate of penetration, reduced quality of measurements, and excess fatigue and wear on downhole components, tools, and/or devices.

SUMMARY

Disclosed herein are systems and methods for reducing, influencing, and/or damping oscillations, such as torsional oscillations, of downhole systems. The systems include a downhole component configured to be disposed downhole and a shock-damping system configured at least one of on and in the downhole component, the shock-damping system configured to reduce vibrations of the downhole component by imparting a shock to the downhole component if a vibration of the downhole component equals or exceeds a shock threshold vibration.

According to some embodiments, methods of reducing, influencing, and/or damping oscillations, such as torsional oscillations, of downhole systems are provided. The methods include installing a shock-damping system at least one of on and in a downhole component located on a downhole string of the downhole system, the damping system comprising at least one damper element arranged relative to the downhole component and configured to reduce vibrations of the downhole component. The at least one damper element is configured to move relative to the downhole component to contact the downhole component and impart a shock thereto if a vibration of the downhole component equals or exceeds a shock threshold vibration.

BRIEF DESCRIPTION OF THE DRAWINGS

The subject matter, which is regarded as the invention, is particularly pointed out and distinctly claimed in the claims at the conclusion of the specification. The foregoing and other features and advantages of the invention are apparent from the following detailed description taken in conjunction with the accompanying drawings, wherein like elements are numbered alike, in which:

DETAILED DESCRIPTION

Figure 1:
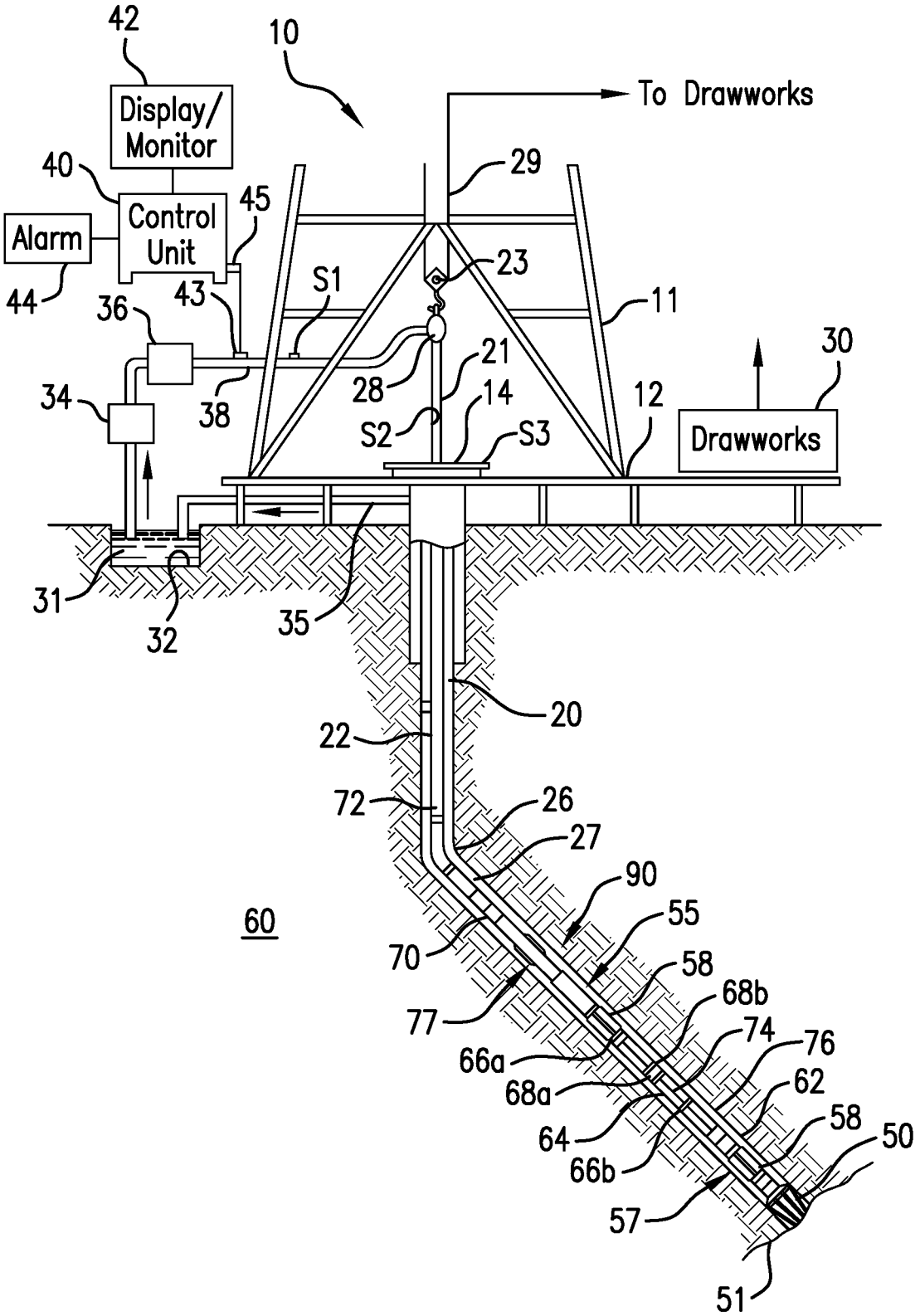
FIG. 1 is an example of a system for performing downhole operations that can employ embodiments of the present disclosure.

FIG. 1 shows a schematic diagram of a system for performing downhole operations. As shown, the system is a drilling system 10 that includes a drill string 20 having a drilling assembly 90, also referred to as a bottomhole assembly (BHA), conveyed in a borehole 26 penetrating an earth formation 60. The drilling system 10 includes a conventional derrick 11 erected on a floor 12 that supports a rotary table 14 that is rotated by a prime mover, such as an electric motor (not shown), at a desired rotational speed. The drill string 20 includes a drilling tubular 22, such as a drill pipe, extending downward from the rotary table 14 into the borehole 26. A disintegration device 50, such as a drill bit attached to the end of the BHA 90, disintegrates the geological formations when it is rotated to drill the borehole 26. The drill string 20 is coupled to surface equipment such as systems for lifting, rotating, and/or pushing, including, but not limited to, a drawworks 30 via a kelly joint 21, swivel 28 and line 29 through a pulley 23. In some embodiments, the surface equipment may include a top drive (not shown). During the drilling operations, the drawworks 30 is operated to control the weight on bit, which affects the rate of penetration. The operation of the drawworks 30 is well known in the art and is thus not described in detail herein.

During drilling operations a suitable drilling fluid 31 (also referred to as the "mud") from a source or mud pit 32 is circulated under pressure through the drill string 20 by a mud pump 34. The drilling fluid 31 passes into the drill string 20 via a desurger 36, fluid line 38 and the kelly joint 21. The drilling fluid 31 is discharged at the borehole bottom 51 through an opening in the disintegration device 50. The drilling fluid 31 circulates uphole through the annular space 27 between the drill string 20 and the borehole 26 and returns to the mud pit 32 via a return line 35. A sensor S1 in the fluid line 38 provides information about the fluid flow rate. A surface torque sensor S2 and a sensor S3 associated with the drill string 20 respectively provide information about the torque and the rotational speed of the drill string. Additionally, one or more sensors (not shown) associated with line 29 are used to provide the hook load of the drill string 20 and about other desired parameters relating to the drilling of the borehole 26. The system may further include one or more downhole sensors 70 located on the drill string 20 and/or the BHA 90.

In some applications the disintegration device 50 is rotated by only rotating the drill pipe 22. However, in other applications, a drilling motor 55 (for example, a mud motor) disposed in the drilling assembly 90 is used to rotate the disintegration device 50 and/or to superimpose or supplement the rotation of the drill string 20. In either case, the rate of penetration (ROP) of the disintegration device 50 into the earth formation 60 for a given formation and a given drilling assembly largely depends upon the weight on bit and the drill bit rotational speed. In one aspect of the embodiment of FIG. 1, the drilling motor 55 is coupled to the disintegration device 50 via a drive shaft (not shown) disposed in a bearing assembly 57. The drilling motor 55 rotates the disintegration device 50 when the drilling fluid 31 passes through the drilling motor 55 under pressure. The bearing assembly 57 supports the radial and axial forces of the disintegration device 50, the downthrust of the drilling motor and the reactive upward loading from the applied weight on bit. Stabilizers 58 coupled to the bearing assembly 57 and/or other suitable locations act as centralizers for the drilling assembly 90 or portions thereof.

A surface control unit 40 receives signals from the downhole sensors 70 and devices via a transducer 43, such as a pressure transducer, placed in the fluid line 38 as well as from sensors S1, S2, S3, hook load sensors, RPM sensors, torque sensors, and any other sensors used in the system and processes such signals according to programmed instructions provided to the surface control unit 40. The surface control unit 40 displays desired drilling parameters and other information on a display/monitor 42 for use by an operator at the rig site to control the drilling operations. The surface control unit 40 contains a computer, memory for storing data, computer programs, models and algorithms accessible to a processor in the computer, a recorder, such as tape unit, memory unit, etc. for recording data and other peripherals. The surface control unit 40 also may include simulation models for use by the computer to processes data according to programmed instructions. The control unit responds to user commands entered through a suitable device, such as a keyboard. The surface control unit 40 is adapted to activate alarms 44 when certain unsafe or undesirable operating conditions occur.

The drilling assembly 90 also contains other sensors and devices or tools for providing a variety of measurements relating to the formation surrounding the borehole and for drilling the borehole 26 along a desired path. Such devices may include a device for measuring the formation resistivity near and/or in front of the drill bit, a gamma ray device for measuring the formation gamma ray intensity and devices for determining the inclination, azimuth and position of the drill string. A formation resistivity tool 64, made according an embodiment described herein may be coupled at any suitable location, including above a lower kick-off subassembly or steering unit 62, for estimating or determining the resistivity of the formation near or in front of the disintegration device 50 or at other suitable locations. An inclinometer 74 and a gamma ray device 76 may be suitably placed for respectively determining the inclination of the BHA and the formation gamma ray intensity. Any suitable inclinometer and gamma ray device may be utilized. In addition, an azimuth device (not shown), such as a magnetometer or a gyroscopic device, may be utilized to determine the drill string azimuth. Such devices are known in the art and therefore are not described in detail herein. In the above-described exemplary configuration, the drilling motor 55 transfers power to the disintegration device 50 via a shaft that also enables the drilling fluid to pass from the drilling motor 55 to the disintegration device 50. In an alternative embodiment of the drill string 20, the drilling motor 55 may be coupled below the resistivity measuring device 64 or at any other suitable place.

Still referring to FIG. 1, other logging-while-drilling (LWD) devices (generally denoted herein by numeral 77), such as devices for measuring formation porosity, permeability, density, rock properties, fluid properties, etc. may be placed at suitable locations in the drilling assembly 90 for providing information useful for evaluating the subsurface formations along borehole 26. Such devices may include, but are not limited to, temperature measurement tools, pressure measurement tools, borehole diameter measuring tools (e.g., a caliper), acoustic tools, nuclear tools, nuclear magnetic resonance tools and formation testing and sampling tools.

The above-noted devices transmit data to a downhole telemetry system 72, which in turn transmits the received data uphole to the surface control unit 40. The downhole telemetry system 72 also receives signals and data from the surface control unit 40 and transmits such received signals and data to the appropriate downhole devices. In one aspect, a mud pulse telemetry system may be used to communicate data between the downhole sensors 70 and devices and the surface equipment during drilling operations. A transducer 43 placed in the fluid line 38 (e.g., mud supply line) detects the mud pulses responsive to the data transmitted by the downhole telemetry system 72. Transducer 43 generates electrical signals in response to the mud pressure variations and transmits such signals via a conductor 45 to the surface control unit 40. In other aspects, any other suitable telemetry system may be used for two-way data communication (e.g., downlink and uplink) between the surface and the BHA 90, including but not limited to, an acoustic telemetry system, an electro-magnetic telemetry system, an optical telemetry system, a wired pipe telemetry system which may utilize wireless couplers or repeaters in the drill string or the borehole. The wired pipe telemetry system may be made up by joining drill pipe sections, wherein each pipe section includes a data communication link, such as a wire, that runs along the pipe. The data connection between the pipe sections may be made by any suitable method, including but not limited to, hard electrical or optical connections, induction, capacitive, resonant coupling, such as electromagnetic resonant coupling, or directional coupling methods. In case a coiled-tubing is used as the drill pipe 22, the data communication link may be run along a side of the coiled-tubing.

The drilling system described thus far relates to those drilling systems that utilize a drill pipe to convey the drilling assembly 90 into the borehole 26, wherein the weight on bit is controlled from the surface, typically by controlling the operation of the drawworks. However, a large number of the current drilling systems, especially for drilling highly deviated and horizontal boreholes, utilize coiled-tubing for conveying the drilling assembly downhole. In such application a thruster is sometimes deployed in the drill string to provide the desired force on the drill bit. Also, when coiled-tubing is utilized, the tubing is not rotated by a rotary table but instead it is injected into the borehole by a suitable injector while the downhole motor, such as drilling motor 55, rotates the disintegration device 50. For offshore drilling, an offshore rig or a vessel is used to support the drilling equipment, including the drill string.

Still referring to FIG. 1, a resistivity tool 64 may be provided that includes, for example, a plurality of antennas including, for example, transmitters 66*a* or 66*b* and/or receivers 68*a* or 68*b*. Resistivity can be one formation property that is of interest in making drilling decisions. Those of skill in the art will appreciate that other formation property tools can be employed with or in place of the resistivity tool 64.

Liner drilling can be one configuration or operation used for providing a disintegration device becomes more and more attractive in the oil and gas industry as it has several advantages compared to conventional drilling. One example of such configuration is shown and described in commonly owned U.S. Pat. No. 9,004,195, entitled "Apparatus and Method for Drilling a Borehole, Setting a Liner and Cementing the Borehole During a Single Trip," which is incorporated herein by reference in its entirety. Importantly, despite a relatively low rate of penetration, the time of getting the liner to target is reduced because the liner is run in-hole while drilling the borehole simultaneously. This may be beneficial in swelling formations where a contraction of the drilled well can hinder an installation of the liner later on. Furthermore, drilling with liner in depleted and unstable reservoirs minimizes the risk that the pipe or drill string will get stuck due to hole collapse.

Although FIG. 1 is shown and described with respect to a drilling operation, those of skill in the art will appreciate that similar configurations, albeit with different components, can be used for performing different downhole operations. For example, wireline, wired pipe, liner drilling, reaming, coiled tubing, and/or other configurations can be used as known in the art. Further, production configurations can be employed for extracting and/or injecting materials from/into earth formations. Thus, the present disclosure is not to be limited to drilling operations but can be employed for any appropriate or desired downhole operation(s).

Severe vibrations in drill strings and bottomhole assemblies during drilling operations can be caused by cutting forces at the bit or mass imbalances in downhole tools such as drilling motors. Such vibrations can result in reduced rate of penetration, reduced quality of measurements made by tools of the bottomhole assembly, and can result in wear, fatigue, and/or failure of downhole components. As appreciated by those of skill in the art, different vibrations exist, such as lateral vibrations, axial vibrations, and torsional vibrations. For example, stick/slip of the whole drilling system and high-frequency torsional oscillations ("HFTO") are both types of torsional vibrations.

The terms "vibration," "oscillation," as well as "fluctuation," are used with the same broad meaning of repeated and/or periodic movements or periodic deviations of a mean value, such as a mean position, a mean velocity, a mean acceleration, a mean force, and/or a mean torque. In particular, these terms are not meant to be limited to harmonic deviations, but may include all kinds of deviations, such as, but not limited to periodic, harmonic, and statistical deviations. Torsional vibrations may be excited by self-excitation mechanisms that occur due to the interaction of the drill bit or any other cutting structure such as a reamer bit and the formation. The main differentiator between stick/slip and HFTO is the frequency and typical mode shapes: For example, HFTO have a frequency that is typically above 50 Hz compared to stick/slip torsional vibrations that typically have frequencies below 1 Hz. Moreover, the excited mode shape of stick/slip is typically a first mode shape of the whole drilling system whereas the mode shape of HFTO can be of higher order and are commonly localized to smaller portions of the drilling system with comparably high amplitudes at the point of excitation that may be the bit or any other cutting structure (such as a reamer bit), or any contact between the drilling system and the formation (e.g., by a stabilizer).

Due to the high frequency of the vibrations, HFTO correspond to high acceleration and torque values along the BHA. Those skilled in the art will appreciate that for torsional movements, one of acceleration, force, and torque is always accompanied by the other two of acceleration, force, and torque. In that sense, acceleration, force, and torque are equivalent in the sense that none of these can occur without the other two. The loads of high frequency vibrations can have negative impacts on efficiency, reliability, and/or durability of electronic and mechanical parts of the BHA. Embodiments provided herein are directed to providing torsional vibration damping upon the downhole system to mitigate HFTO. In some embodiments of the present disclosure, the torsional vibration damping can be activated if a threshold of a measured property, such as a torsional vibration amplitude or frequency is achieved within the system.

In accordance with a non-limiting embodiment provided herein, a torsional vibration damping system may be based on friction dampers. For example, according to some embodiments, friction between two parts, such as two interacting bodies, in the BHA or drill string can dissipate energy and reduce the level of torsional oscillations, thus mitigating the potential damage caused by high frequency vibrations. Preferably, the energy dissipation of the friction damper is at least equal to the HFTO energy input caused by the bit-rock interaction.

Friction dampers, as provided herein, can lead to a significant energy dissipation and thus mitigation of torsional vibrations. When two components or interacting bodies are in contact with each other and move relative to each other, a friction force acts in the opposite direction of the velocity of the relative movement between the contacting surfaces of the components or interacting bodies. The friction force leads to a dissipation of energy.

Although specifically described with respect to friction dampers, dampers, damper elements, and damper systems of the present disclosure are not limited to friction. That is, as described below, other principles of damping may be implemented using dampers of different configurations. For example, damping may be generated by viscous damping, friction damping, hydraulic damping, magnetic damping (e.g., eddy current damping), piezoelectric (shunt) damping, etc. A damper element, as used herein, may be part of a damping system that is configured to dissipate energy due to relative movement between at least a part of the damper element and a downhole string. That is, relative movement of a damper element, or part thereof, enables dissipation of energy (e.g., HFTO), and thus may reduce vibration within or along a downhole string.

Figure 2:
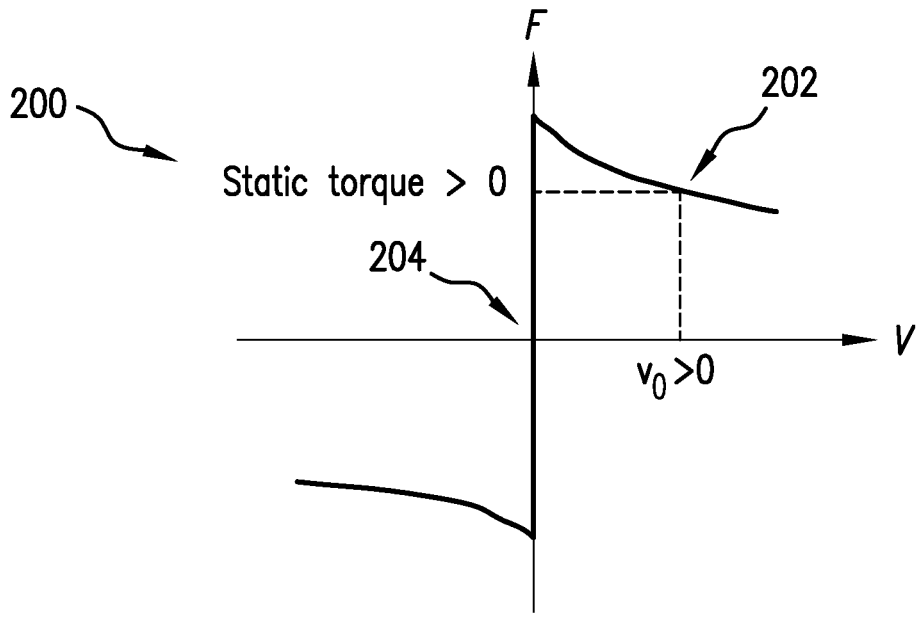
FIG. 2 is an illustrative plot of a typical curve of frictional force or torque versus relative velocity or relative rotational speed between two interacting bodies.

FIG. 2 is an illustrative plot 200 of a typical curve of the friction force or torque versus relative velocity $\nu$ (e.g., or relative rotational speed) between two interacting bodies. The two interacting bodies have a contact surface and a force component $F_N$ perpendicular to the contact surface engaging the two interacting bodies. Plot 200 illustrates the dependency of friction force F or torque of the two interacting bodies with a velocity-weakening behavior, such as frictional contact or a characteristic of a cutting behavior. At higher relative velocities ($\nu>0$) between the two interacting bodies, the friction force or torque has a distinct value, illustrated by point 202. Decreasing the relative velocity will lead to an increasing friction force or torque (also referred to as velocity-weakening characteristic). The friction force or torque reaches its maximum when the relative velocity is zero. The maximum friction force is also known as static friction, sticking friction, or stiction.

Generally, friction force $F_R$ depends on the normal force as described in the equation $F_R=\mu\cdot F_N$, with friction coefficient $\mu$. Generally, the friction coefficient $\mu$ is a function of velocity. Herein, the normal force can also be fluctuating corresponding to an excited vibration in the normal direction. In the case that the relative speed between two interacting bodies is zero ($\nu=0$), the static friction force $F_S$ is related to the normal force component $F_N$ by the equation $F_S=\mu_0\cdot F_N$ with the static friction coefficient $\mu_0$. In the case that the relative speed between the two interacting bodies is not zero ($\nu\neq0$), the friction coefficient is known as dynamic friction coefficient $\mu$. If the relative velocity is further decreased to negative values (i.e., if the direction the relative movement of the two interacting bodies is switched to the opposite), the friction force or torque switches to the opposite direction with a high absolute value corresponding to a step from a positive maximum to a negative minimum at point 204 in plot 200. That is, the friction force versus velocity shows a sign change at the point where the velocity changes the sign and is discontinuous at point 204 in plot 200. Velocity-weakening characteristic is a well-known effect between interacting bodies that are frictionally connected. The velocity-weakening characteristic of the contact force or torque is assumed to be a potential root cause for stick/slip. Velocity-weakening characteristic may also be achieved by utilizing dispersive fluid with a higher viscosity at lower relative velocities and a lower viscosity at higher relative velocities. If a dispersive fluid is forced through a relatively small channel, the same effect can be achieved in that the flow resistance is relatively high or low at low or high relative velocities, respectively.

Figure 8A:
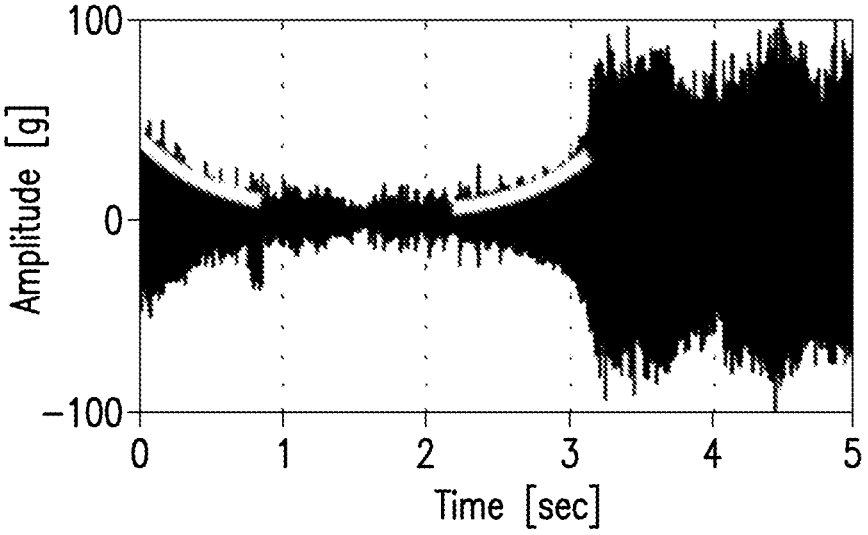
FIG. 8A is a plot of tangential acceleration measured at a bit.
Figure 8B:
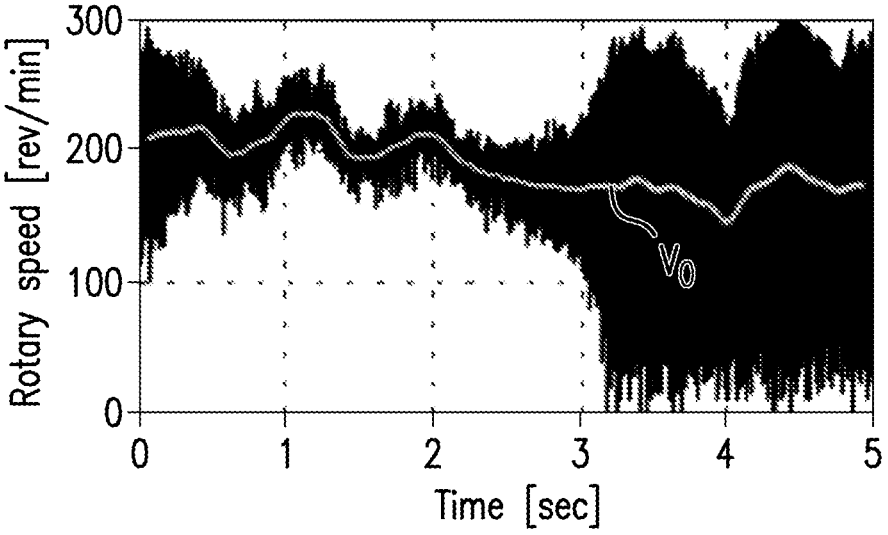
FIG. 8B is a plot corresponding to FIG. 8A illustrating rotary speed.

With reference to FIGS. 8A-8B, FIG. 8A illustrates measured torsional acceleration of a downhole system versus time. In the 5 second measurement time shown in FIG. 8A, FIG. 8A shows oscillating torsional acceleration with a mean acceleration of approximately 0 g, overlayed by oscillating torsional accelerations with a relatively low amplitude between approximately 0 s and 3 s and relatively high amplitudes up to 100 g between approximately 3 s and 5 s. FIG. 8B illustrates the corresponding rotary velocity in the same time period as in FIG. 8A. In accordance with FIG. 8A, FIG. 8B illustrates a mean velocity $\nu_0$ (indicated by the line $\nu_0$ in FIG. 8B) which is relatively constant at approximately 190 rev/min. The mean velocity is overlayed by oscillating rotary velocity variations with relatively low amplitudes between approximately 0 s and 3 s and relatively high amplitudes between approximately 3 s and 5 s in accordance with the relatively low and high acceleration amplitudes in FIG. 8A. Notably, the oscillating rotary speed does not lead to negative values of the rotary velocity, even not in the time period between approximately 3 s and 5 s when the amplitudes of the rotary speed oscillations are relatively high.

Referring again to FIG. 2, point 202 illustrates a mean velocity of the two interacting bodies that is according to the mean velocity $\nu_0$ in FIG. 8B. In the schematic illustration of FIG. 2, the data of FIG. 8B corresponds to a point with a velocity oscillating with relatively high frequency due to HTFO around the mean velocity $\nu_0$ that varies relatively slowly with time compared to the HFTO. The point illustrating the data of FIG. 8B therefore moves back and forth on the positive branch of the curve in FIG. 2 without or only rarely reaching negative velocity values. Accordingly, the corresponding friction force or torque oscillates around a positive mean friction force or mean friction torque and is generally positive or only rarely reaches negative values. As discussed further below, the point 202 illustrates where a positive mean value of the relative velocity corresponds to a static torque and the point 204 illustrates a favorable point for friction damping. It is noted that friction forces or torque between the drilling system and the borehole wall will not generate additional damping of high frequency oscillations in the system. This is because the relative velocity between the contact surfaces of the interacting bodies (e.g., a stabilizer and the borehole wall) does not have a mean velocity that is so close to zero that the HFTO lead to a sign change of the relative velocity of the two interacting bodies. Rather, the relative velocity between the two interacting bodies has a high mean value at a distance from zero that is large so that the HFTO do not lead to a sign change of the relative velocity of the two interacting bodies (e.g., illustrated by point 202 in FIG. 2).

As will be appreciated by those of skill in the art, the weakening characteristic of the contact force or torque with respect to the relative velocity as illustrated in FIG. 2, leads to an application of energy into the system for oscillating relative movements of the interacting bodies with a mean velocity $v_0$ that is high compared to the velocity of the oscillating movement. In this context, other examples of self-excitation mechanisms such as coupling between axial and torsional degree of freedom could lead to a similar characteristic.

Figure 3:
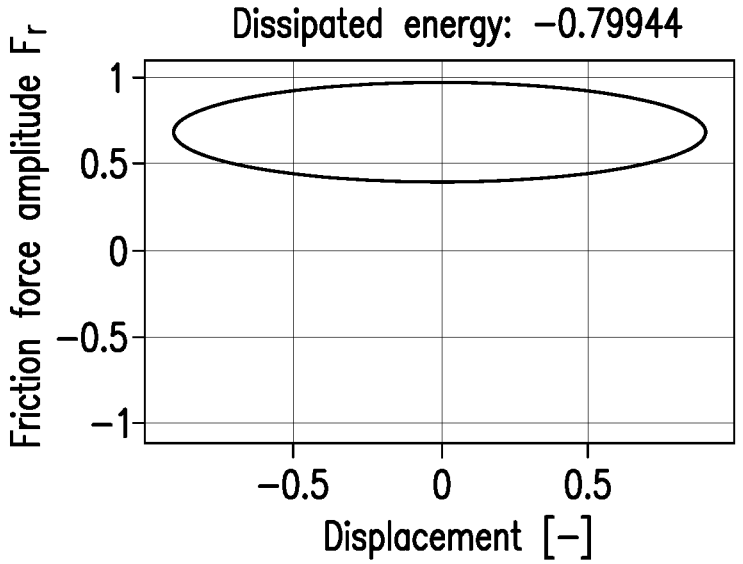
FIG. 3 is a hysteresis plot of a friction force versus displacement for a positive relative mean velocity with additional small velocity fluctuations.
Figure 4:
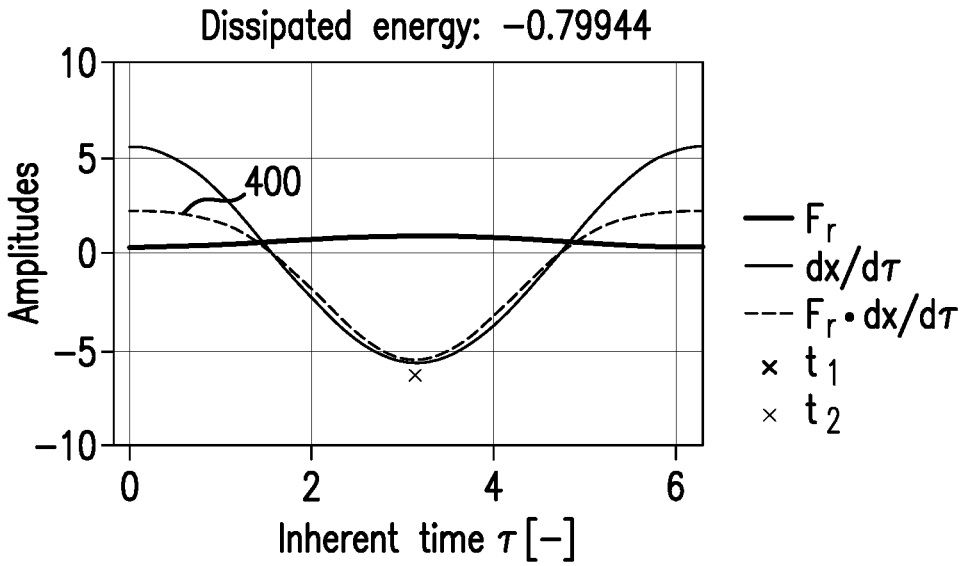
FIG. 4 is a plot of friction force, relative velocity, and a product of both versus. time for a positive relative mean velocity with additional small velocity fluctuations.

The corresponding hysteresis is depicted in FIG. 3 and the time plot for the friction force and velocity is shown in FIG. 4. FIG. 3 illustrates hysteresis of a friction force $F_r$, sometimes also referred to as a cutting force in this context, versus displacement relative to a location that is moving with a positive mean relative velocity with additional small velocity fluctuations leading to additional small displacement dx. Accordingly, FIG. 4 illustrates the friction force ($F_r$), relative velocity $$\left(\frac{dx}{d\tau}\right),$$

and a product of both (indicated by label 400 in FIG. 4) for a positive mean relative velocity with additional small velocity fluctuations leading to additional small displacement dx. Those skilled in the art, will appreciate that the area between the friction force and the velocity over time is equal to the dissipated energy (i.e., the area between the line 400 and the zero axis), which is negative in the case that is illustrated by FIG. 3 and FIG. 4. That is, in the case illustrated by FIGS. 3 and 4, energy is transferred into the oscillation from the friction via the frictional contact.

Figure 5:
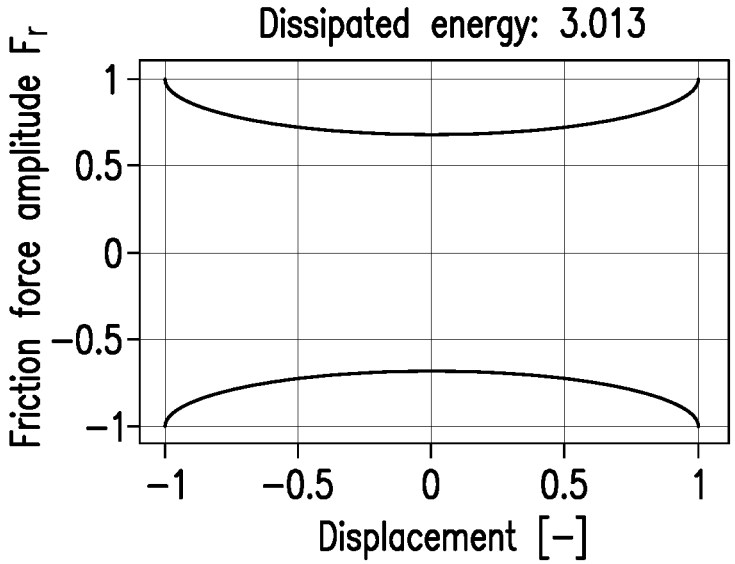
FIG. 5 is a hysteresis plot of a friction force versus displacement for a relative mean velocity of zero with additional small velocity fluctuations.
Figure 6:
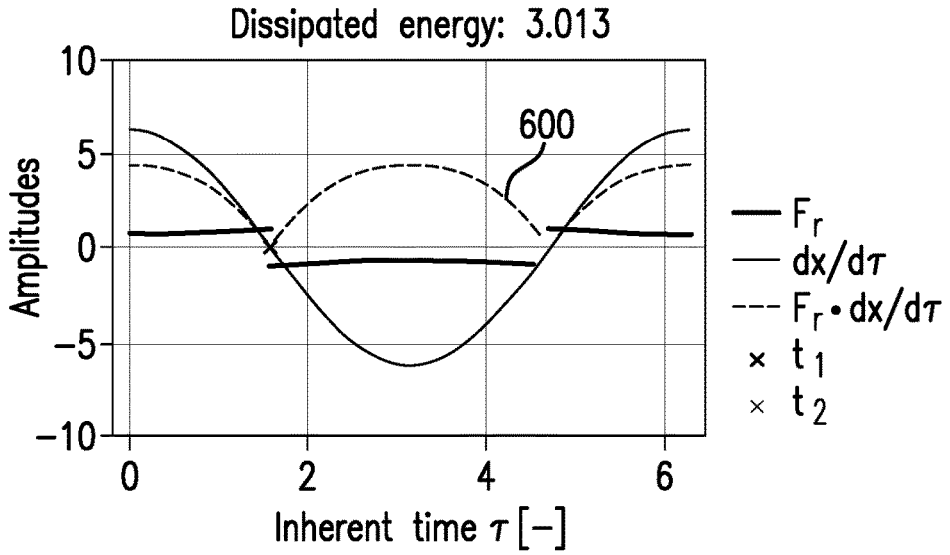
FIG. 6 is a plot of friction force, relative velocity, and a product of both for a relative mean velocity of zero with additional small velocity fluctuations.

Referring again to FIG. 2, the point 204 denotes the favorable mean velocity for friction damping of small velocity fluctuations or vibrations in addition to the mean velocity. For small fluctuations of the relative movement between the two interacting bodies, the discontinuity at point 204 in FIG. 2 with the sign change of the relative velocity of the interacting bodies also leads to an abrupt sign change of the friction force or torque. This sign change leads to a hysteresis that leads to a large amount of dissipated energy. For example, compare FIGS. 5 and 6, which are similar plots to FIGS. 3 and 4, respectively, but illustrate the case of zero mean relative velocity with additional small velocity fluctuations or vibrations. The area below the line 600 in FIG. 6 that corresponds to the product $$F_r \cdot \frac{dx}{d\tau}$$

is equal to the dissipated energy during one period and is, in this case, positive. That is, in the case illustrated by FIGS. 5 and 6, the energy is transferred from the high frequency oscillation via the frictional contact into the friction. The effect is comparably high compared to the case illustrated by FIGS. 3 and 4 and has the desired sign. It is also clear from the comparison of FIGS. 2, 5, and 6 that the dissipated energy significantly depends on the difference between maximum friction force and minimum friction force for $v=0$ (i.e., location 204 in FIG. 2). The higher the difference between maximum friction force and minimum friction force for $v=0$, the higher is the dissipated energy. While FIGS. 3-4 were generated by using a velocity weakening characteristics, such as the one shown in FIG. 2, embodiments of the present disclosure are not limited to such type of characteristics. The apparatuses and methods disclosed herein will be functional for any type of characteristic provided that the friction force or torque undergoes a step with a sign change when the relative velocity between the two interacting bodies changes its sign.

Friction dampers in accordance with some embodiments of the present disclosure will now be described. The friction dampers are installed on or in a drilling system, such as drilling system 10 shown in FIG. 1, and/or are part of drilling system 10, such as part of the bottomhole assembly 90. The friction dampers are part of friction damping systems with two interacting bodies, such as a first element and a second element having a frictional contact surface with the first element. The friction damping systems of the present disclosure are arranged so that the first element has a mean velocity that is related to the rotary speed of the drilling system to which it is installed. For example, the first element may have a similar or the same mean velocity or rotary speed as the drilling system, so that small fluctuating oscillations lead to a sign change or zero crossing of the relative velocity between the first element and second element according to point 204 in FIG. 2.

It is noted that friction forces or torque between the drilling system and the borehole wall will not generate additional damping of high frequency oscillations in the system. This is because the relative velocity between the contact surfaces (e.g., a stabilizer and the borehole) does not have a zero mean value (e.g., point 202 in FIG. 2). In accordance with embodiments described herein, the static friction between the first element and the second element are set to be high enough to enable the first element to accelerate the second element (during rotation) to a mean velocity $v_0$ with the same value as the drilling system. Additional high frequency oscillations, therefore, introduce slipping between the first element (e.g., damping device) and the second element (e.g., drilling system) with positive or negative velocities according to oscillations around a position in FIG. 2 that is equal to or close to point 204 in FIG. 2. Slipping occurs if the inertial force $F_1$ exceeds the static friction force, expressed as the static friction coefficient multiplied by the normal force between the two interacting bodies: $F_1 > \mu_0 \cdot F_N$. In accordance with embodiments of the present disclosure, the normal force $F_N$ (e.g. caused by the contact and surface pressure of the contact surface between the two interacting bodies) and the static friction coefficient $\mu_0$ are adjusted to achieve an optimal energy dissipation or an optimal amplitude. Further, the moment of inertia (torsional), the contact and surface pressure of the contacting surfaces, and the placement of the damper or contact surface with respect to the distance from bit may be optimized.

Figure 7:
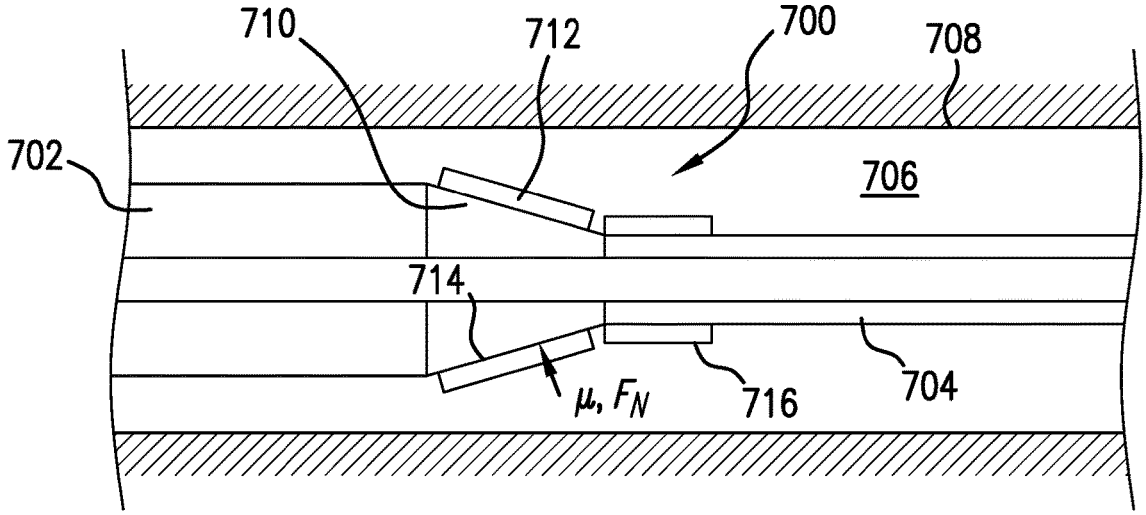
FIG. 7 is a schematic illustration of a damping system in accordance with an embodiment of the present disclosure.

For example, turning to FIG. 7, a schematic illustration of a damping system 700 in accordance with an embodiment of the present disclosure is shown. The damping system 700 is part of a downhole system 702, such as a bottomhole assembly and/or a drilling assembly. The downhole system 702 includes a string 704 that is rotated to enable a drilling operation of the downhole system 702 to form a borehole 706 within a formation 708. As discussed above, the borehole 706 is typically filled with drilling fluid, such as drilling mud. The damping system 700 includes a first element 710 that is operatively coupled, e.g. fixedly connected or an integral part of the downhole system 702, so as to ensure that the first element 710 rotates with a mean velocity that is related to, e.g. similar to or same as the mean velocity of the downhole system 702. The first element 710 is in frictional contact with a second element 712. The second element 712 is at least partially movably mounted on the downhole system 702, with a contact surface 714 located between the first element 710 and the second element 712.

In the case of frictional forces, the difference between the minimum and maximum friction force is positively dependent on the normal force and the static friction coefficient. The dissipated energy increases with friction force and the harmonic displacement, but, only in a slip phase, energy is dissipated. In a sticking phase, the relative displacement between the friction interfaces and the dissipated energy is zero. The upper amplitude limit of the sticking phase increases linearly with the normal force and the friction coefficient in the contact interface. The reason is that the reactive force in the contact interface, $J\ddot{x} \geq M_H = F_N \mu_H r$, that can be caused by the inertia J of one of the contacting bodies if it is accelerated with $\ddot{x}$ has to be higher than the torque $M_H = F_N \mu_H r$ that defines the limit between sticking and slipping. As used herein, $F_N$ is the normal force and $\mu_H$ is the effective friction coefficient and r is the effective or mean radius of the friction contact area. For complex frictional contacts parts of the interacting bodies, sticking or slipping can occur at the same time. Herein the contact pressure can be optimized to achieve an optimal damping and amplitude.

Similar mechanisms apply if the contact force is caused by a displacement and spring element. The acceleration $\ddot{x}$ of the contact area can be due to an excitation of a torsional oscillation mode and is dependent upon the corresponding mode shape, as further discussed below with respect to FIG. 9B. In case of an attached inertia mass J the acceleration $\ddot{x}$ is equal to the acceleration of the excited mode and corresponding mode shape at the attachment position as long as the contact interface is sticking.

The normal force and friction force have to be adjusted to guarantee a slipping phase in an adequate or tolerated amplitude range. A tolerated amplitude range can be defined by an amplitude that is between zero and the limits of loads that are, for example, given by design specifications of tools and components. A limit could also be given by a percentage of the expected amplitude without the damper. The dissipated energy that can be compared to the energy input, e.g., by a forced or self-excitation, is one measure to judge the efficiency of a damper. Another measure is the provided equivalent damping of the system that is proportional to the ratio of the dissipated energy in one period of a harmonic vibration to the potential energy during one period of vibration in the system. This measure is especially effective in case of self-excited systems. In the case of self-excited systems, the excitation can be approximated by a negative damping coefficient and both the equivalent damping and the negative damping can be directly compared. The damping force that is provided by the damper is nonlinear and strongly amplitude dependent.

Figure 14:
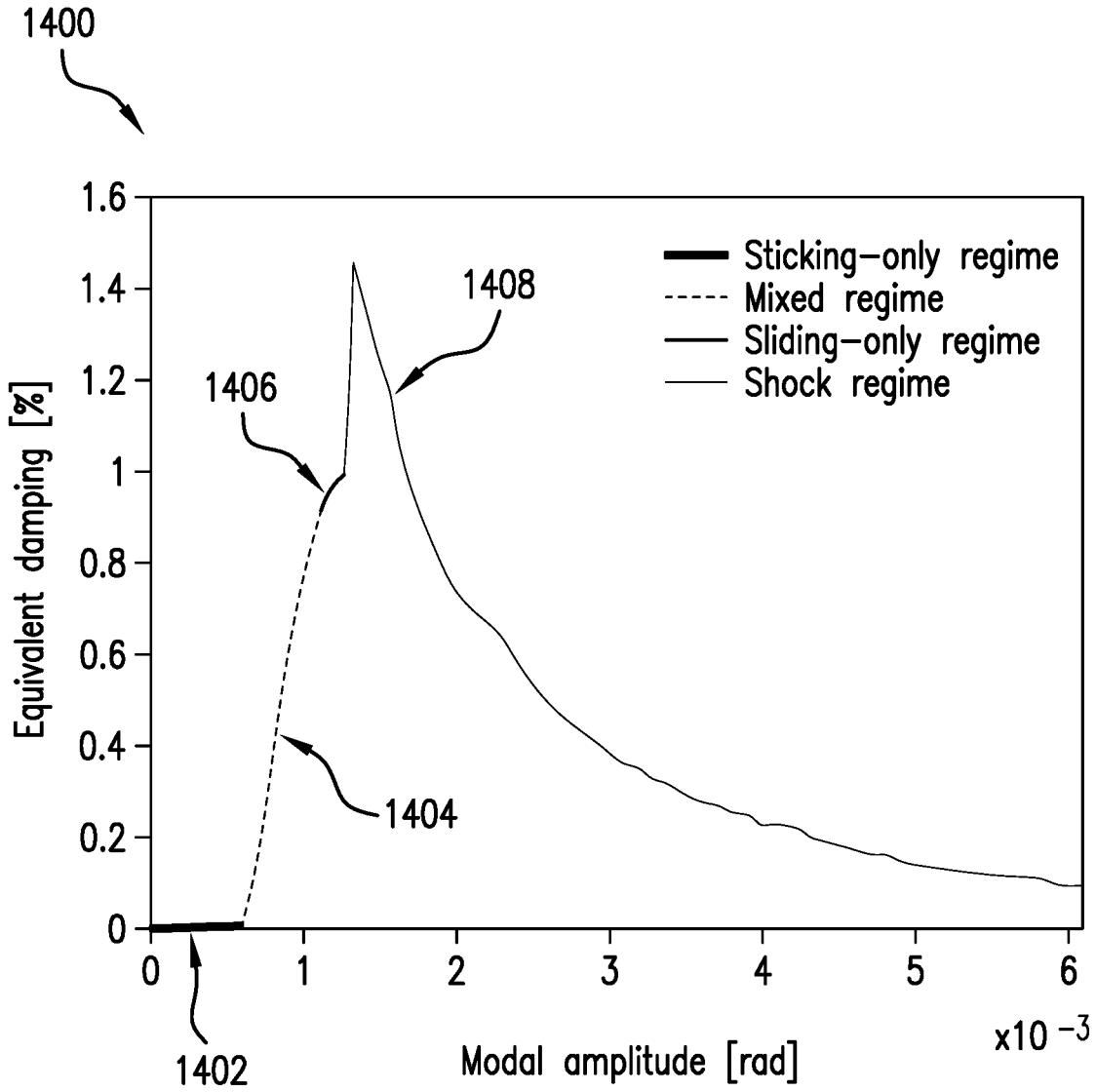
FIG. 14 is a schematic plot of damping achieved at various modal amplitudes when employing a configuration in accordance with an embodiment of the present disclosure.

As shown in FIG. 14, the damping is zero in the sticking phase (left end of plot of FIG. 14) where the relative movement between the interacting bodies is zero. If, as described above, the limit between the sticking and slipping phase is exceeded by the force that is transferred through the contact interface, a relative sliding motion is occurring that causes the energy dissipation. The damping ratio provided by the friction damping is then increasing to a maximum and afterwards declining to a minimum. The amplitude that will be occurring is dependent upon the excitation that could be described by the negative damping term. Herein, the maximum of the damping provided, as depicted in FIG. 14, has to be higher than the negative damping from the self-excitation mechanism. The amplitude that is occurring in a so-called limit cycle can be determined by the intersection of the negative damping ratio and the equivalent damping ratio that is provided by the friction damper.

The curve is dependent on different parameters. It is beneficial to have a high normal force but a sliding phase that occurs at a minimum amplitude of the bottomhole assembly. In the case of the inertia mass, this can be achieved by a high mass or by placing the contact interface at a point of high acceleration with respect to the excited mode shape. In the case of contacting interfaces, a high relative displacement in comparison to the amplitude of the mode shape at the contact point, e.g., along the axial axis of the BHA, is beneficial. Therefore, an optimal placement of the damping device according to a high amplitude or relative amplitude is important. This can be achieved by using simulation results, as discussed below. The normal force and the friction coefficient can be used to shift the curve to lower or higher amplitudes but does not have a high influence on the damping maximum. If more than one friction damper is implemented, this would lead to a superposition of similar curves shown in FIG. 14. If the normal force and friction coefficients are adjusted to achieve the maximum at the same amplitude, this is beneficial for the overall damping that is achieved. Further, slightly shifted damping curves would lead to a resulting curve that could be broader with respect to the amplitude that could be beneficial to account for impacts that could shift the amplitude to the right of the maximum. In this case, the amplitude would increase to a very high value in case of self-excited systems as indicated by the negative damping. In this case, the amplitude needs to be shifted again to the left side of the maximum, e.g., by going off bottom or reducing the rotary speed of the system to lower levels. The amplitude in this context approximately linearly scaled by the mean rotary speed as indicated and discussed with respect to FIG. 8B.

Referring again to FIG. 7, the string 704, and thus the downhole system 702, rotates with a rotary speed $$\frac{d\varphi}{d\tau},$$

that may be measured in revolutions per minute (RPM). The second element 712 is mounted onto the first element 710. A normal force $F_N$ between the first element 710 and the second element 712 can be selected or adjusted through application and use of an adjusting element 716. The adjusting element 716 may be adjustable, for example via a thread, an actuator, a piezoelectric actuator, a hydraulic actuator, and/or a spring element, to apply force that has a component in the direction perpendicular to the contact surface 714 between the first element 710 and the second element 712. For example, as shown in FIG. 7, the adjusting element 716 may apply a force in axial direction of downhole system 702, that translates into a force component $F_N$ that is perpendicular to the contact surface 714 of first element 710 and second element 712 due to the non-zero angle between the axis of the downhole system 702 and the contact surface 714 of first element 710 and second element 712. In some configurations, an angle between the system 712 and the inertia mass element is selected or defined to allow a sliding motion and avoid self-locking.

The second element 712 has a moment of inertia J. When HFTO occurs during operation of the downhole system 702, both the downhole system 702 and the second element 712 are accelerated according to a mode shape (e.g., defines the amplitude distribution along the dimensions of the drilling system, drill string, and/or BHA) and the amplitude of the mode (e.g., scales the amplitude of the mode shape). Exemplary results of such operation are shown in FIGS. 8A and 8B. FIG. 8A is a plot of tangential acceleration measured at a bit and FIG. 8B is a corresponding rotary speed.

Due to the tangential acceleration and the inertia of the second element 712, relative inertial forces occur between the second element 712 and the first element 710. If these inertial forces exceed a damping threshold between sticking and slipping, i.e., if these inertial forces exceed static friction force between the first element 710 and the second element 710, a relative movement between the elements 710, 712 will occur that leads to energy dissipation. In such arrangements, the accelerations, the static and/or dynamic friction coefficient, and the normal force determine the amount of dissipated energy. For example, the moment of inertia J of the second element 712 determines the relative force that has to be transferred between the first element 710 and the second element 712. High accelerations and moments of inertia increase the tendency for slipping at the contact surface 714 and thus lead to a higher energy dissipation and equivalent damping ratio provided by the damper.

Due to the energy dissipation that is caused by frictional movement between the first element 710 and the second element 712, heat and wear will be generated on the first element 710 and/or the second element 712. To keep the wear below an acceptable level, materials can be used for the first and/or second elements 710, 712 that can withstand the wear. For example, diamonds or polycrystalline diamond compacts can be used for, at least, a portion of the first and/or second elements 710, 712. Alternatively, or in addition, coatings may help to reduce the wear due to the friction between the first and second elements 710, 712. The heat can lead to high temperatures and may impact reliability or durability of the first element 710, the second element 712, and/or other parts of the downhole system 702. The first element 710 and/or the second element 712 may be made of a material with high thermal conductivity or high heat capacity and/or may be in contact with a material with high thermal conductivity or heat capacity.

Such materials with high thermal conductivity include, but are not limited to, metals or compounds including metal, such as copper, silver, gold, aluminum, molybdenum, tungsten or thermal grease comprising fat, grease, oil, epoxies, silicones, urethanes, and acrylates, and optionally fillers such as diamond, metal, or chemical compounds including metal (e.g., silver, aluminum in aluminum nitride, boron in boron nitride, zinc in zinc oxide), or silicon or chemical compounds including silicon (e.g., silicon carbide). In addition or alternatively, one or both of the first element 710 and the second element 712 may be in contact with a fluid, such as the drilling fluid, that is configured to remove heat from the first element 710 and/or the second element 712 in order to cool the respective element 710, 712. Further, an amplitude limiting element (not shown), such as a key, a recess, or a spring element may be employed and configured to limit the energy dissipation to an acceptable limit that reduces the wear.

When arranging the damping system 700, a high normal force and/or static or dynamic friction coefficient will prevent a relative slipping motion between the first element 710 and the second element 712, and in such situations, no energy will be dissipated. In contrast, a low normal force and/or static or dynamic friction coefficient can lead to a low friction force, and slipping will occur but the dissipated energy is low. In addition, low normal force and/or static or dynamic friction coefficient may lead to the case that the friction at the outer surface of the second element 712, e.g., between the second element 712 and the formation 708, is higher than the friction between first element 710 and second element 712, thus leading to the situation that the relative velocity between first element 710 and second element 712 is not equal to or close to zero but is in the range of the mean velocity between downhole system 702 and formation 708. As such, the normal force and the static or dynamic friction coefficient and the placement of the damper element with respect to the exited mode and mode shape may be adjusted (e.g., by using the adjusting element 716) to achieve an optimized value for energy dissipation.

This can be done by adjusting the normal force $F_N$, the static friction coefficient $\mu_0$, the dynamic friction coefficient $\mu$, the placement of the damper element with respect to the excited mode shape, or combinations thereof. The normal force $F_N$ can be adjusted by positioning the adjusting element 716 and/or by actuators that generate a force on one of the first and second elements with a component perpendicular to the contact surface of first and second element, by adjusting the pressure regime around first and second element, or by increasing or decreasing an area where a pressure is acting on. For example, by increasing the outer pressure that acts on the second element, such as the mud pressure, the normal force $F_N$ will be increased as well. Adjusting the pressure of the mud downhole may be achieved by adjusting the mud pumps (e.g., mud pumps 34 shown in FIG. 1) on surface or other equipment on surface or downhole that influences the mud pressure, such as bypasses, valves, desurgers. The normal force can be adjusted to be harmonic with the same frequency as the natural frequency of the excited mode shape and thus have low normal force values for low acceleration of the inertia mass and high normal force values for low accelerations of the inertia mass and therefor allow sliding motion for low acceleration values.

The normal force $F_N$ may also be adjusted by a biasing element (not shown), such as a spring element, that applies force on the second element 712, e.g. a force in an axial direction away from or toward the first element 710. Adjusting the normal force $F_N$ may also be done in a controlled way based on an input received from a sensor. For example, a suitable sensor (not shown) may provide one or more parameter values to a controller (not shown), the parameter value(s) being related to the relative movement of the first element 710 and the second element 712 or the temperature of one or both of the first element 710 and the second element 712. Based on the parameter value(s), the controller may provide instruction to increase or decrease the normal force $F_N$. For example, if the temperature of one or both of the first element 710 and the second element 712 exceeds a threshold temperature, the controller may provide instruction to decrease the normal force $F_N$ to prevent damage to one or both of the first element 710 and the second element 712 due to high temperatures. Similarly, for example, if a distance, velocity, or acceleration of the second element 712 relative to the first element 710 exceeds a threshold, the controller may provide instructions to increase or decrease the normal force $F_N$ to ensure optimal energy dissipation. By monitoring the parameter value, the normal force $F_N$ may be controlled to achieve desired results over a time period. For instance, the normal force $F_N$ may be controlled to provide optimal energy dissipation while keeping the temperature of one or both of the first element 710 and the second element 712 below a threshold for a drilling run or a portion thereof.

Additionally, the static or dynamic friction coefficient can be adjusted by utilizing different materials, for example, without limitation, material with different stiffness, different roughness, and/or different lubrication. For example, a surface with higher roughness often increases the friction coefficient. Thus, the friction coefficient can be adjusted by choosing a material with an appropriate friction coefficient for at least one of the first and the second element or a part of at least one of the first and second element. The material of first and/or second element may also have an effect on the wear of the first and second element. To keep the wear low of the first and second element it is beneficial to choose a material that can withstand the friction that is created between the first and second elements. The inertia, the friction coefficient, and the expected acceleration amplitudes (e.g., as a function of mode shape and eigenfrequency) of the second element 712 are parameters that determine the dissipated energy and also need to be optimized. The critical mode shapes and acceleration amplitudes can be determined from measurements or calculations or based on other known methods as will be appreciated by those of skill in the art. Examples are a finite element analysis or the transfer matrix method or finite differences method and based on this a modal analysis or analytical models. The placement of the friction damper is optimal where a high relative displacement or acceleration is expected.

Figure 9A:
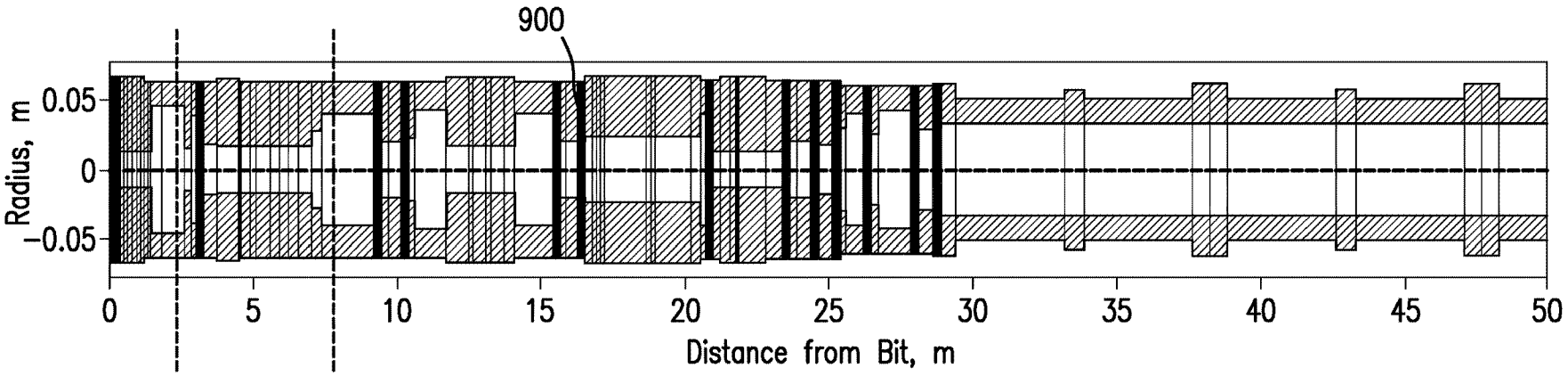
FIG. 9A is a schematic plot of a downhole system illustrating a shape of a downhole system as a function of distance-from-bit.
Figure 9B:
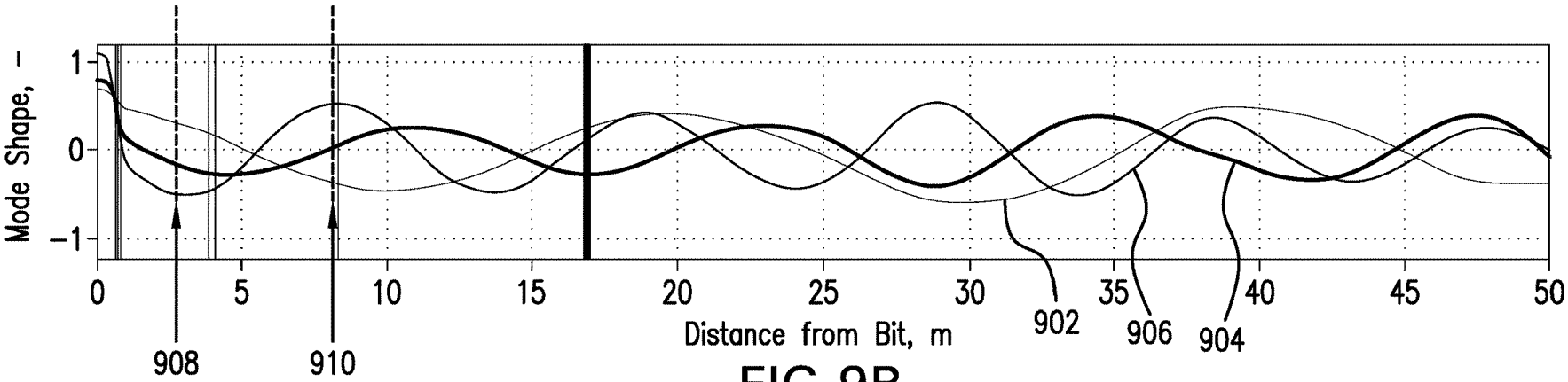
FIG. 9B illustrates example corresponding mode shapes of torsional vibrations that may be excited during operation of the downhole system of FIG. 9A.

Turning now to FIGS. 9A and 9B, an example of a downhole system 900 and corresponding torsional oscillation modes are shown. FIG. 9A is a schematic plot of a downhole system illustrating a shape of a downhole system as a function of distance-from-bit, and FIG. 9B illustrates example corresponding mode shapes of torsional oscillations that may be excited during operation of the downhole system of FIG. 9A. The illustrations of FIGS. 9A and 9B demonstrate the potential location and placement of one or more elements of a damping system onto the downhole system 900.

As illustratively shown in FIG. 9A, the downhole system 900 has various components with different diameters (along with differing masses, densities, configurations, etc.) and thus during rotation of the downhole system 900, different components may cause various modes to be generated. The illustrative modes indicate where the highest amplitudes will exist that may require damping by application of a damping system. For example, as shown in FIG. 9B, the mode shape 902 of a first torsional oscillation, the mode shape 904 of a second torsional oscillation, and the mode shape 906 of a third torsional oscillation of the downhole system 900 are shown. Based on the knowledge of mode shapes 902, 904, 906, the position of the first elements of damping system can be optimized. Where an amplitude of a mode shape 902, 904, 906 is maximum (peaks), damping may be required and/or achieved. Accordingly, illustratively shown are two potential locations for attachment or installation of a damping system of the present disclosure.

For example, a first damping location 908 is close to the bit of downhole system 900 and damps the first and third torsional oscillations (corresponding to mode shapes 902, 906) and provides some damping with respect to the second torsional oscillation (corresponding to mode shape 904). That is, the first damping location 908 to be approximately at a peak of the third torsional oscillation (corresponding to mode shape 906), close to peak of the first torsional oscillation mode shape 902, and about half-way to peak with respect to the second torsional oscillation mode shape 904.

A second damping location 910 is arranged to provide damping of the third torsional oscillation mode shape 906 and provide some damping with respect to the first torsional oscillation mode shape 902. However, in the second damping location 910, no damping of the second torsional oscillation mode shape 904 will occur because the second torsional oscillation mode shape 904 is nearly zero at the second damping location 910.

Although only two locations are shown in FIGS. 9A and 9B for placement of damping systems of the present disclosure, embodiments are not to be so limited. For example, any number and any placement of damping systems may be installed along a downhole system to provide torsional vibration damping upon the downhole system. An example of a preferred installation location for a damper is where one or more of the expected mode shapes show high amplitudes.

Due to the high amplitudes at the drill bit, for example, one good location of a damper is close to or even within the drill bit. Further, the first and second elements are not limited to a single body, but can take any number of various configurations to achieve desired damping. That is, multiple body (multi-body) first or second elements (e.g., friction damping devices) with each body having the same or different normal forces, friction coefficients, and moments of inertia can be employed. Such multiple-body element arrangements can be used, for example, if it is uncertain which mode shape and corresponding acceleration is expected at a given position along a downhole system.

For example, two or more element bodies that can achieve different relative slipping motion between each other to dissipate energy may be used. The multiple bodies of the first element can be selected and assembled with different static or dynamic friction coefficients, angles between the contact surfaces, and/or may have other mechanisms to influence the amount of friction and/or the transition between sticking and slipping. Several amplitude levels, excited mode shapes, and/or natural frequencies can be damped with such configurations.

Embodiments of the present disclosure are directed to mitigation of critical drill string vibrations based on shocks. Such vibrations may be in various directions relative to a tool, including HFTO (torsional), axial, and multiple different lateral directions. In accordance with embodiments of the present disclosure, damping and/or reduction in excitation due to energy transfer between a structure and a damper element can be increased if friction or other damping mechanisms described above are combined with shocks. Specifically, embodiments of the present disclosure are directed to systems and methods of imparting a shock into the system to disrupt or modify vibrations in the tools and components. Further, in some embodiments, shocks alone (e.g., without other damping mechanisms) can be employed to mitigate vibrations, as described herein.

The shocks of the systems described herein can act in different ways in the downhole system/tool. For example, in some embodiments and configurations, active shocks or passive shocks can directly extract or transfer energy from the system through specific shock design (e.g., amplitude and phase). In other embodiments, active or passive shocks may transfer energy between critical unstable modes and stable modes, which can increase the damping effect and the stability of an unstable mode. Further, in some embodiments, shocks can be used to dissipate energy through a mechanism (e.g., backlash, hydraulic, electro-magnetic, piezo-electric, etc.), with or without friction or other damping mechanisms. In this context, the combination of special damping principles, such as friction damping through inertia rings or stiffness elements combined with a backlash (e.g., a gap) which leads to shocks above a certain amplitude, shows great advantages regarding the damping effect over conventional friction dampers. In some embodiments, the damping element may be connected to the structure at one or multiple locations and can move relative to the structure at other locations.

In some such configurations, the damper element consists of an inertia element with direct material connection to the structure (e.g., a friction contact). In addition to stabilizing critical vibrations, this increase in the damping effect caused by shocks also has the advantage that lower damping masses or inertias may be employed due to higher damping values achieved. In addition, a precise operating range of the damper element(s) can be defined via a backlash width (or gap extension), for example, depending on parameters such as frequency and amplitude associated with the vibration (e.g., torsional oscillation) of the associated structure (e.g., a downhole component). Additionally, a backlash-based shock can be used as a safety mechanism to increase damping if a conventional damping mechanism fails. Some damping systems are described in U.S. Pat. No. 11,136,834, entitled "Dampers for mitigation of downhole tool vibration," commonly owned and issued on Oct. 2, 2021, the contents of which are incorporated herein in their entirety. This can also be designed to increase damping if a certain vibration amplitude is reached (e.g., a design limit of a tool is reached, which may trigger the shock damping).

Embodiments of the present disclosure provide for dissipation or transfer of energy between torsional oscillation modes directly or indirectly by means of active, semi-active, or passive shock or impact between a damping element or other element and a surface or part of a downhole component that is subject to vibrations. A semi-active configuration may be based on a change of operational range(s) of the damper by adjusting a backlash width. In some embodiments, the combination of a shock-induced damping principle or mechanism (e.g., provided by an additional backlash element) with other damping principles (e.g., friction damping, viscous damping, etc.) is disclosed. Such combination of damping mechanisms provides for an increase in damping of vibrations (e.g., torsional, axial, lateral, etc.).

Shocks and backlash can be used to reduce or mitigate vibration in string dynamics. A mechanical or physical shock, as defined herein, is a sudden acceleration caused, for example, by impact, hammer, backlash, drop, kick, or explosion. Shock is a transient physical excitation. Shock describes matter subject to rates (changes) of force with respect to time. Shock is a vector that has units of an acceleration (i.e., rate of change of velocity). The unit g represents multiples of the acceleration of gravity and is conventionally used. A shock pulse can be characterized by its peak acceleration, the duration, and the shape of the shock pulse (e.g., half sine, triangular, trapezoidal, etc.). As employed herein, backlash is a clearance or lost motion in a mechanism caused by gaps between the parts. It can be defined as the maximum distance or angle through which any part of a mechanical system may be moved in one direction without applying appreciable force or motion to the next part in a mechanical sequence. A shock, as used in a damper system in a downhole application, may use shock amplitudes, for example and without limitation, of 1 g to 1,000 g, or 10 g to 200 g, or 15 g to 100 g, or various other ranges of shock amplitudes, as will be appreciated by those of skill in the art.

Figure 10:
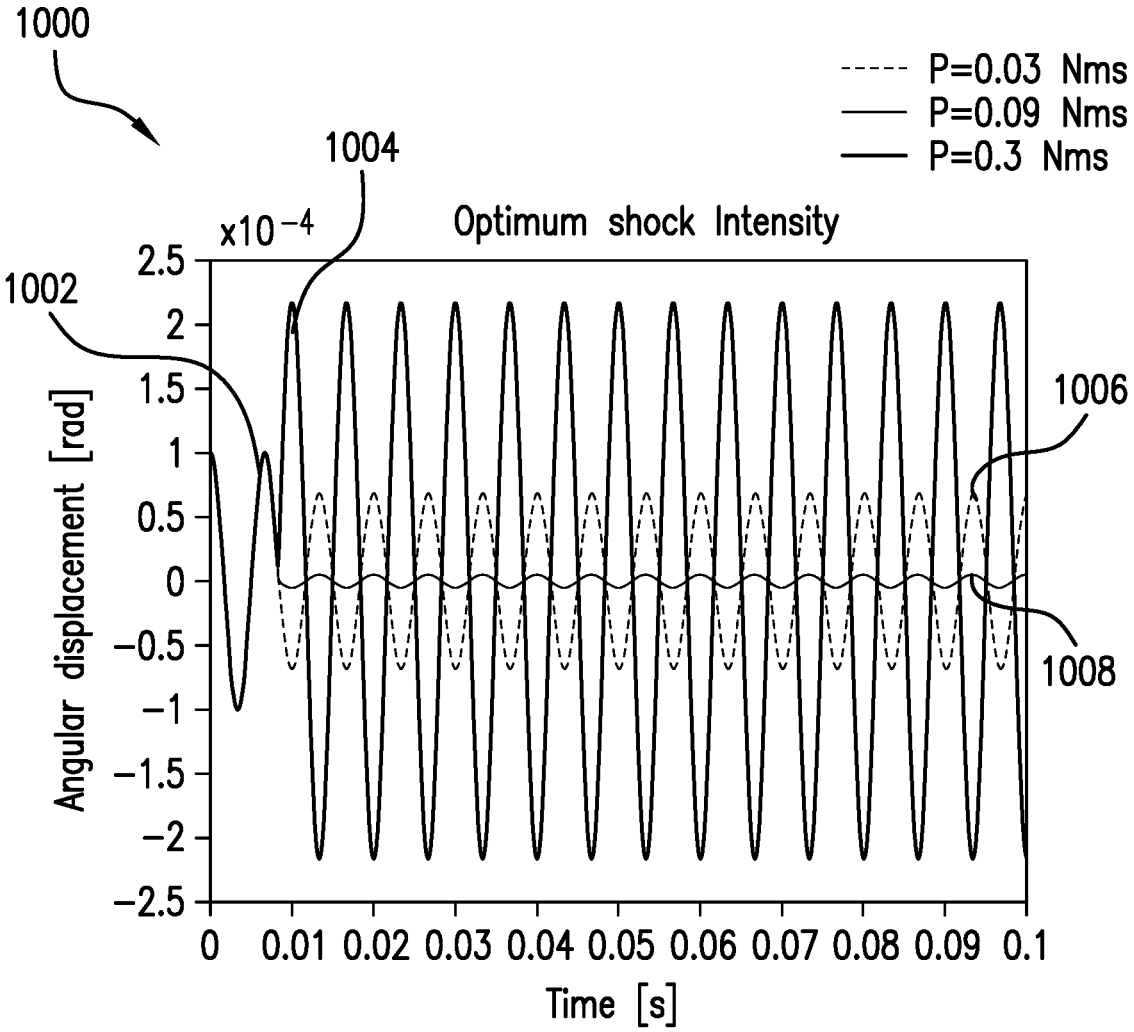
FIG. 10 is a schematic plot of angular displacement over time for various shock intensities in accordance with embodiments of the present disclosure.

Referring now to FIG. 10, a schematic plot 1000 of shock intensity is shown. In plot 1000, the horizontal axis is time (in seconds) and the vertical axis is angular displacement (in radians). FIG. 10 illustrates a system response for a system where a shock occurs at the time t=0.008 s. In the time t<0.008 s, a vibration curve 1002 of a system is shown. The effect of shocks and/or backlash on and in dynamic systems can be complex. Using suitable models, the effect of shocks can be predicted and optimized. For example, for a modal system of a single degree of freedom representing the critical torsional oscillation mode of a drill string, the system response is dependent on the phase and intensity of the shock. Dependent on the intensity P of the shock, the shock can result in an increase or decrease of the amplitude and hence energy of the mode. The phase of a shock, as used herein, refers to the phase of the vibration or torsional oscillation when the shock is applied. The shock may be applied when the vibration amplitude is at a maximum, at a minimum, is zero, or is at any amplitude therebetween. In FIG. 10, the phase of the torsional oscillation at t=0.008 s defines the phase of the shock.

For example, as shown in FIG. 10, for a shock intensity P=0.3 Nms, the vibration of the system is increased in amplitude (vibration curve 1004). However, with a shock intensity P=0.09 Nms, the intensity of the vibrations may be decreased (vibration curve 1006). Further still, with a shock intensity of P=0.03 Nms, the amplitude of the vibrations are decreased even further (vibration curve 1008). In some embodiments, the shock intensity in this illustrative embodiment of P=0.09 Nms may be the preferred shock intensity. Further, it will be appreciated that the plot of FIG. 10 is merely a representation and the same results may be achieved using a constant shock intensity and varying the phase. That is, the intensity of the shock may remain constant while the point in time when the shock is applied relative to the phase of the torsional oscillation is varied.

If the intensity of the shock is too low, the amplitude of the vibration is only slightly affected (vibration curve 1006). If the intensity of the shock is too high, the amplitude of the vibration is not reduced but increased, because the shock has introduced more energy into the system (vibration curve 1004). Between these two extremes there are amplitudes which ensure that the vibration amplitude is optimally reduced (vibration curve 1008). In view of this, targeted conversion of shocks can be achieved in accordance with embodiments of the present disclosure by active systems such as piezo elements, shape memory alloys, motors, and other active circuits. Passive systems may also provide for targeted conversion, and such targeted conversion is not to be limited to active systems. In addition to the direct effect (e.g., damping vibrations), there is also an indirect effect, that may be achieved through embodiments of the present disclosure. In systems with several degrees of freedom, energy can be transferred from one mode to another by using targeted shocks. This can be used to transfer energy from critical self-excited modes to stable modes (often also modes of higher frequency for better energy dissipation) to increase the damping of the critical modes.

In accordance with some embodiments, passively generated shocks can also transfer or dissipate energy directly or indirectly. Passively, shocks can be generated, for example, via backlash between various elements or components of a downhole tool or system. Even with passive shocks, there is still the fact that the phase and strength of the shock have an influence on the mode of action. Therefore, the combination of several elements can result in a strong increase of the damping effect. A combination of shocks and other damping principles (e.g., friction) or delay elements that modify the phase of the shock can be employed to ensure that the phase and amplitude of a shock to the system has a positive effect on the dynamic behavior. In some configurations, a delay element may be an additional damping effect that can be activated and deactivated as needed (e.g., controlled actuation or the like). A delay element may be realized, for example and without limitation, by a spring or rubber element or any other suitable delay element in the damping system.

$$\begin{pmatrix} 1 & 0 \\ 0 & J \end{pmatrix}\begin{pmatrix} \ddot{q} \\ \ddot{x} \end{pmatrix} + \begin{pmatrix} 2D_i\omega_i & 0 \\ 0 & 0 \end{pmatrix}\begin{pmatrix} \dot{q} \\ \dot{x} \end{pmatrix} + \begin{pmatrix} w_i^2 & 0 \\ 0 & 0 \end{pmatrix}\begin{pmatrix} q \\ x \end{pmatrix} = \begin{pmatrix} -\varphi_{i,j}M(\varphi_{i,j}\dot{q} - \dot{x}) \\ M(\varphi_{i,j}\dot{q} - \dot{x}) \end{pmatrix} \quad (1)$$

Equation (1) represents a critical torsional oscillation mode i. In Equation (1), $\omega_i$ is the angular natural frequency of a mode i, $D_i$ is the modal damping, and $\varphi_{i,j}$ is the mass normalized modal amplitude at the position of the drill string or downhole component where the shock-friction damper is located in the drill string relative to the mode i. Further, in Equation (1), a shock-friction damper is represented, with M being the damper element moment and J being the rotational inertia. In Equation (1), x is the displacement of the damper element inertia of the shock-friction damper in a physical coordinate system, $\dot{x}$ is the first time derivative of the displacement and represents the velocity, and $\ddot{x}$ is the second time derivative of the displacement and represents acceleration. In Equation (1), q is the modal displacement of the mode i of the structure (e.g., drill string, BHA, etc.) in a modal coordinate system, $\dot{q}$ is the first time derivative of the modal displacement and represents the modal velocity, and $\ddot{q}$ is the second time derivative of the modal displacement and represents the modal acceleration. The physical displacement/velocity/acceleration of the structure at an axial location j due to the modal displacement of the mode i is determined by the back-transformation $\varphi_{i,j}.\varphi_{i,j}\dot{q}\varphi_{i,j}\ddot{q}$.

The damper element moment M is defined in Equation (2):

$$M(x_{rel}, v_{rel}) = \begin{cases} F_N\mu r\ \mathrm{sgn}(v_{rel}), & |\varphi_{i,j}q - x| < \beta_S \\ F_N\mu r\ \mathrm{sgn}(v_{rel}) + dv_{rel}^e + c(|x_{rel}| - \beta_S)^e \mathrm{sgn}(x_{rel}), & |\varphi_{i,j}q - x| \geq \beta_S \end{cases} \quad (2)$$

The damper element moment M consists of the friction moment (normal force $F_N$, coefficient of friction μ, mean radius of the friction contact area r) as well as a mechanical backlash with a contact stiffness c, damping constant d, an angular backlash width 2*βs and a linearity constant e which models a linear stiffness and damping value for e=1. In Equation (2) the coefficient of friction μ may be velocity dependent. Further, in Equation (2), $v_{rel}$ is the relative velocity between the structure and the damper element (e.g., inertia ring) both at an axial location j ($v_{rel}=\varphi_{i,j}\dot{q}-\dot{x}$), $x_{rel}$ is the relative displacement between the displacement x of the damper element (e.g., inertia ring) and the position of the contact connected to the structure (e.g., end stop) ($x_{rel}=\varphi_{i,j}q-x$), and $|x_{rel}|-\beta_S$ is the indentation depth at the contact. In accordance with some embodiments, the backlash width may be defined by $2*\beta_s$, where $\beta_s$ is defined as $$\beta_s = \frac{F_N\mu r\pi}{2J\omega_i^2}$$

and a corresponding modal amplitude is approximated by $$\hat{q}_{opt} = \frac{\pi F_N\mu r}{\sqrt{2}J\varphi_{i,j}\omega_i^2}.$$

If the relative displacement exceeds the backlash width (or gap extension), the shock/impact will occur. In some embodiments, two different exponents may be employed for linear damping and quadratic stiffness (e.g., Hertzian contact e=3/2).

Figure 11:
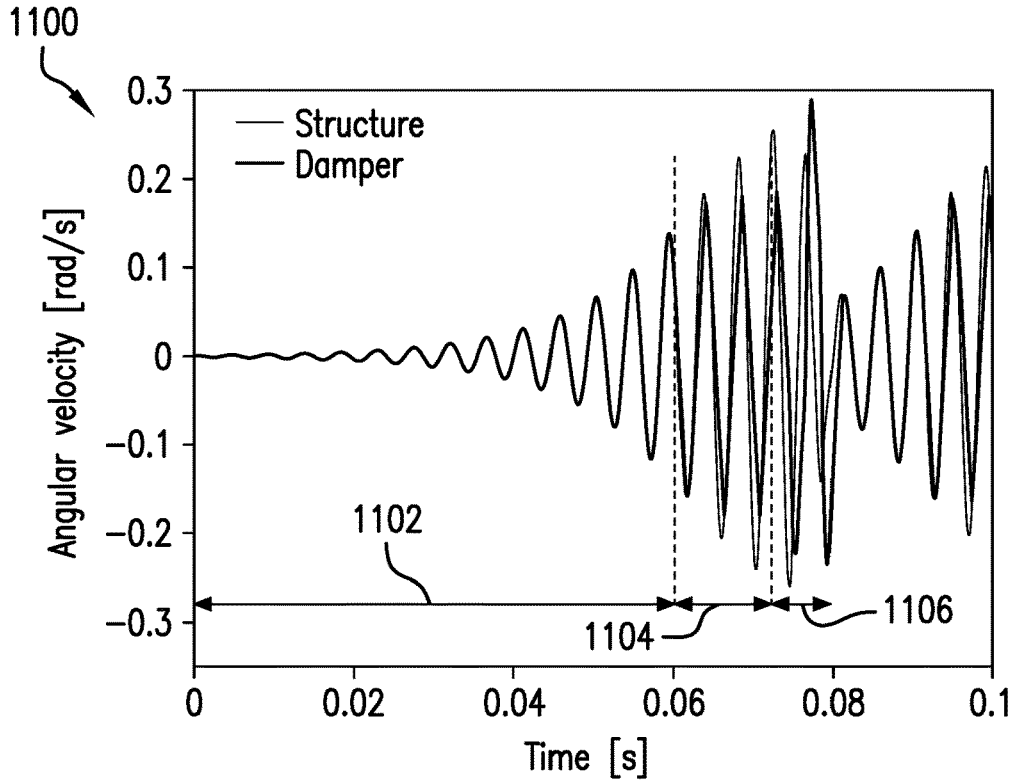
FIG. 11 is a schematic plot of angular velocities over time of a structure and a damper in accordance with an embodiment of the present disclosure.
Figure 12:
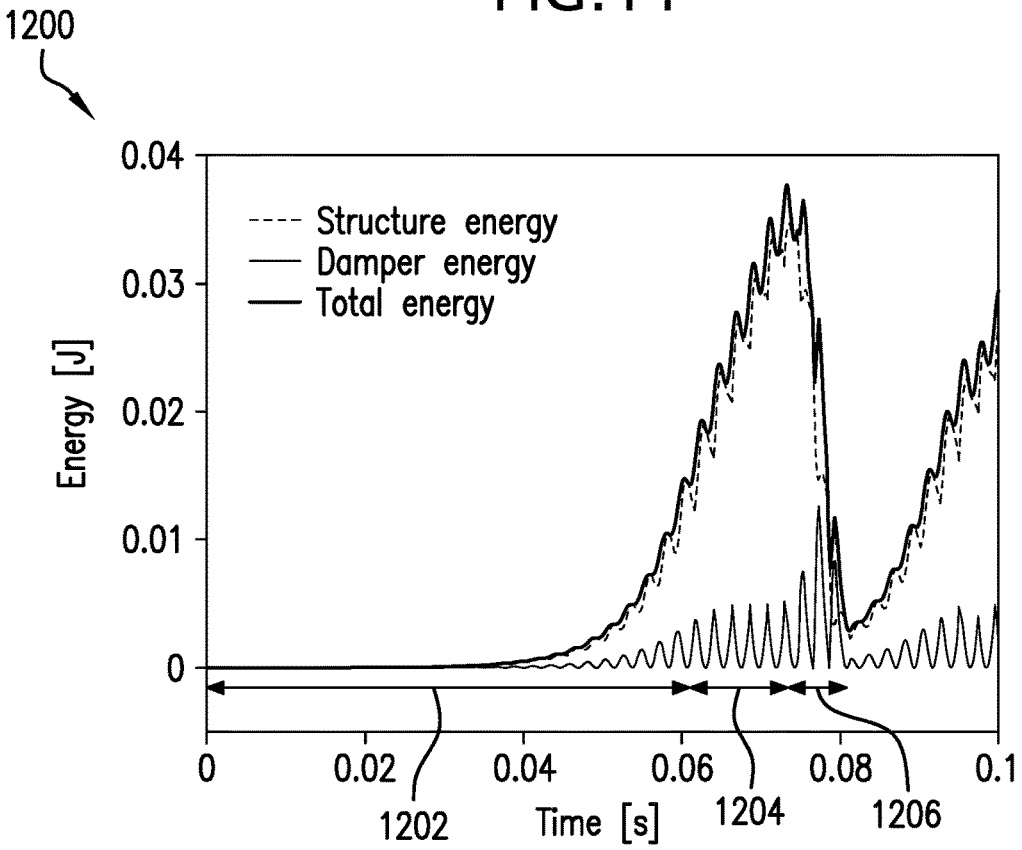
FIG. 12 is a schematic plot of energy over time of a structure, a damper element, and sum of the two of a system in accordance with an embodiment of the present disclosure.

In the following description and explanation, e=1 and d=0, for use in Equation (2). If the backlash width is exceeded, a shock occur between the damper element at location x and the structure ($|x_{rel}|\geq\beta_S$). The backlash and the resulting shocks change the amplitude-dependent dynamic behavior of the damper. The damper is reflected at the contact due to the shock energy and moves into an opposite direction, away from the contact. For self-excited systems as they occur in drill string dynamics, FIGS. 11-12 illustrate the angular velocity (FIG. 11; radians/sec) and the energy (FIG. 12; Joules) of the shock-friction damper and the structure in plots 1100, 1200 as a function of time (seconds), respectively. At small amplitudes, sticking occurs, similar to pure friction dampers (Sticking regime 1102, 1202). From a certain amplitude $$\left(\hat{q}_{sliding} = \pm\frac{F_N\mu r}{\varphi_{i,j}J\omega_i^2}\right.$$

if $|x_{rel}|-\beta>0$), there is a relative displacement and velocity between the damper element and the structure and energy is dissipated (Sliding regime 1104, 1204), regular damper mode, no shocks. If the amplitude continues to increase because the damping is not sufficient to stabilize the instable mode ($|x_{rel}|\beta_S$), shocks occur in the shock phase and energy is transferred from the structure to the damper element, resulting in an increased damping effect (shock regime 1106, 1206). As a result, the transferred energy in the damper element (e.g., inertia ring) can increase the relative velocity in the friction contact and, therefore, increase the friction power. Due to the energy transfer to the damper element, the damper element may be reflected between two contacts. Due to the reflection and the energy transfer, the damper element may oscillate at a higher angular velocity than without the shocks (sliding regime). Another effect may be that due to the energy transfer from the structure to the damper element, the energy of the self-excited structure will be reduced. This may result in a reduced energy input due to self-excitation.

In plot 1100, during the sticking regime 1102, the damper element and the structure are frictionally stuck together, and thus move (e.g., slide, rotate, vibrate, etc.) together as a single joined assembly. However, in the sliding regime 1104, the damper element separates from the structure, and the damper element can move independently of the structure (e.g., relative movement). Although the term "independent" is being used here, this does not mean that there is complete independence between the elements. For example, the direction will be dependent upon the movement of the structure and the structure angular velocity (e.g., drill string rotation). For some of the damping mechanism, for example frictional damping, the damper element moves relative to the downhole component with a velocity that is a sum of a periodic velocity fluctuation having an amplitude and a mean velocity, wherein the mean velocity is lower than the amplitude of the periodic velocity fluctuation. The mean velocity of the damper element depends on the angular velocity of the structure to which it is operably connected to (e.g., the downhole component, the drill string, etc.). When the amplitude of the vibration is increased, the shock regime is entered. The shock regime 1106 represents the results of the damper element contacting the structure to impart a shock to the system, resulting in a reduction in total energy, as illustrated in FIG. 12. It will be appreciated that the total decrease in energy is due to the damping and energy transfer effects achieved by the system as a whole.

Figure 13:
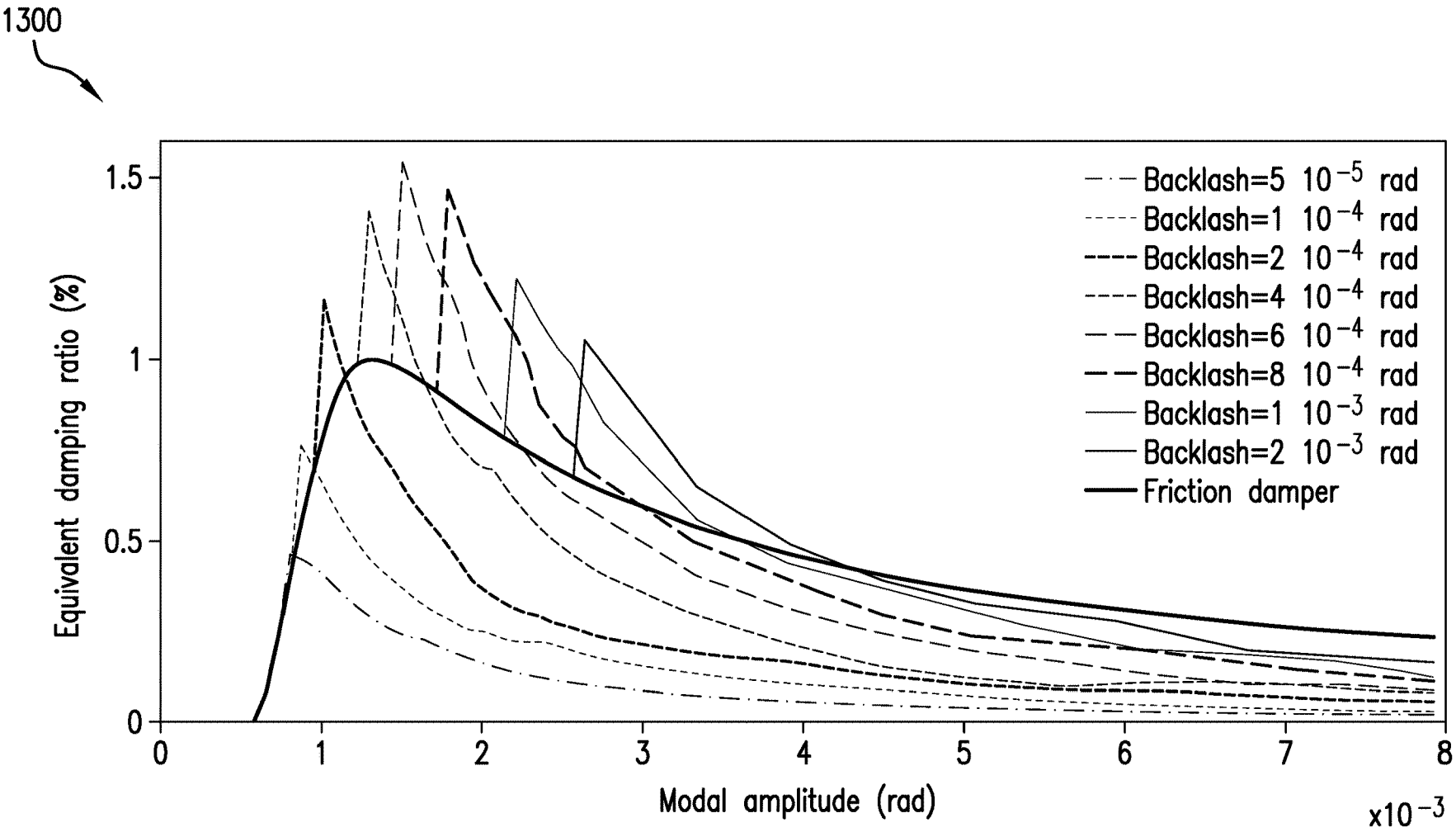
FIG. 13 is a schematic plot of damping achieved by different backlash of different widths in accordance with embodiments of the present disclosure.

The results with respect to stability can be illustrated in the damping diagrams in FIGS. 13-14. FIGS. 13-14 illustrates plots 1300, 1400 and demonstrate the effects of different backlash widths (gap extensions) on the damping effect in combination with the damping effect of a conventional friction damper. It should be recognized that there is an optimum backlash width may depend on several parameters such as frequency of the mode (e.g., angular frequency of the mode), inertia of the damper element, friction torque, and initial relative displacement may also determine the time the shock occurs relative to the phase of the torsional oscillation, among other influencing factors $$\left(\text{e.g., } \beta_s \sim \frac{F_N \mu r \pi}{2J\omega_i^2}\right).$$

There may be sudden increases in the damping effect (equivalent damping in FIG. 13) due to the occurrence of shocks in the shock regime. Other influencing factors may include, without limitation, the inertia, the positioning with respect to the distance from bit that influences the amplitude of the mode at the location of the damper system. Additionally, the distance between the damper element and the contact at the structure may influence the system (backlash). It will be appreciated that this does not mean a distance to the bit, but rather the phase of the torsional oscillation relative to the time of the application or occurrence of the shock, or alternatively, when the backlash width becomes zero (e.g., end stop is contacted). Stated another way, the initial relative displacement between the structure and the damper does not have to be $x_{re1}=0$, but can also be any other value between $\pm\beta_s$.

In plot 1300 of FIG. 13, a number of different shock-damper configurations including a friction damper mechanism are represented as they apply to various different modal amplitudes. In FIG. 13 various different size backlash widths (gap extensions) are illustrated. The dimensions of the various backlashes are indicated in arclength (or dimension in radians). Plot 1300 illustrates the generated equivalent damping in percentage (%) at a torsional vibration that has a modal amplitude measured in rad (instead of angular degrees °). In case of a backlash installed in the system, the damper element inertia engages the contact if the torsional displacement (relative displacement) of the damper element (e.g., inertia ring) exceeds the backlash width. At this point the contact generates a shock, which increases the damping due to the increased relative velocity between the inertia ring and the structure (e.g., BHA/drill string) caused by the shock, as described above. The higher the backlash width, the greater the torsional displacement where (or when (e.g., phase of torsional oscillation)) an increase of damping occurs or a reduction of torsional vibration amplitude occurs. The time when the shock occurs relative to the phase of the torsional oscillation is also referred to herein as "shock phase."

Plot 1400 of FIG. 14 illustrates a sticking only regime 1402, transitioning into a mixed regime 1404, a sliding only regime 1406, and a shock regime 1408. A backlash may be selected or optimized to a shock regime occurring at a modal amplitude or at modal amplitudes that experience a high equivalent damping through the conventional damping mechanism (no shocks, e.g., friction damping of the conventional damper part of the shock-damping system). Thus, the shock increases the equivalent damping of a conventional damper. As illustrated in FIG. 13, the highest equivalent damping is achieved for a backlash of $6*10^{-4}$ rad and a modal amplitude of around 1.5 rad. The modal amplitude relates to the distance from the bit (for a specific downhole system configuration (BHA, downhole formation, borehole parameter (diameter, inclination))). Therefore, the modal amplitude can be considered a measure for the distance from bit. If the backlash is selected to damp modal amplitudes that are not experiencing high damping through the conventional damper, then optimal equivalent damping theoretically possible for the configuration is not achieved. The damping is then not as big as it could be, and the vibrational energy dissipated or transferred to another mode is not as effective as possible. Therefore, optimization of the backlash, such as selection of the most effective backlash extension (gap extension), may be an important factor when designing a damping and backlash system in accordance with embodiments of the present disclosure. It will be appreciated that, in accordance with embodiments of the present disclosure, the goal of the backlash optimization is a maximum equivalent damping.

The backlash may be optimized or predefined based on various different parameters, including and without limitation, frequency (angular frequency), inertia of the damper element, normal force, initial relative displacement, distance to the bit (or modal amplitude), and torque (e.g., friction torque). As well as that, there is a sudden increase in the damping effect due to the occurrence of shocks in the shock regime. Other influencing factors are the inertia as well as the positioning with respect to the distance from bit that influences the amplitude of the torsional oscillation. In some embodiments, the damper element and the backlash may be positioned on, in, or proximate a bit (disintegrating device) of a drilling system, for example, because mode deflection at the bit is usually high in self-excited BHA torsional oscillation modes. This is because, referring to Equation (2), d=0, and thus the total energy is dissipated in the friction contact and the shock only provides energy transfer. However, if d>0, then energy may also be dissipated through the shock action.

It will be appreciated that the optimal backlash may be difficult to achieve in a real-world application and system. As such, it may be advantageous and in accordance with some embodiments of the present disclosure to have a backlash extension being within an acceptable range. For example, a backlash that is close to an optimized backlash may provide sufficient results to provide the benefits described herein, without being perfectly optimized. For example, a backlash extension being within 20% (e.g., 20% or less) performance from an optimized backlash may be employed without departing from the scope of the present disclosure, and thus may achieve sufficient equivalent damping. In another embodiment, a backlash extension being less than 10% off an optimized backlash extension may be suited to achieve a sufficient equivalent damping. In yet another embodiment, a backlash extension being less than 5% off the optimized backlash extension may be suited to achieve a sufficient equivalent damping.

Figure 15A:
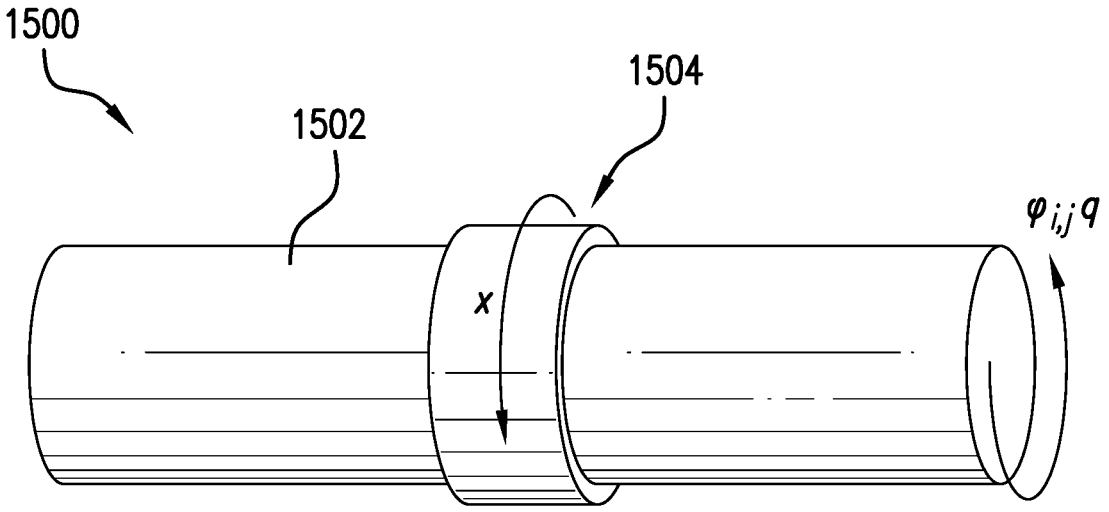
FIG. 15A is a side schematic illustration of a shock-friction damper system in accordance with an embodiment of the present disclosure.
Figure 15B:
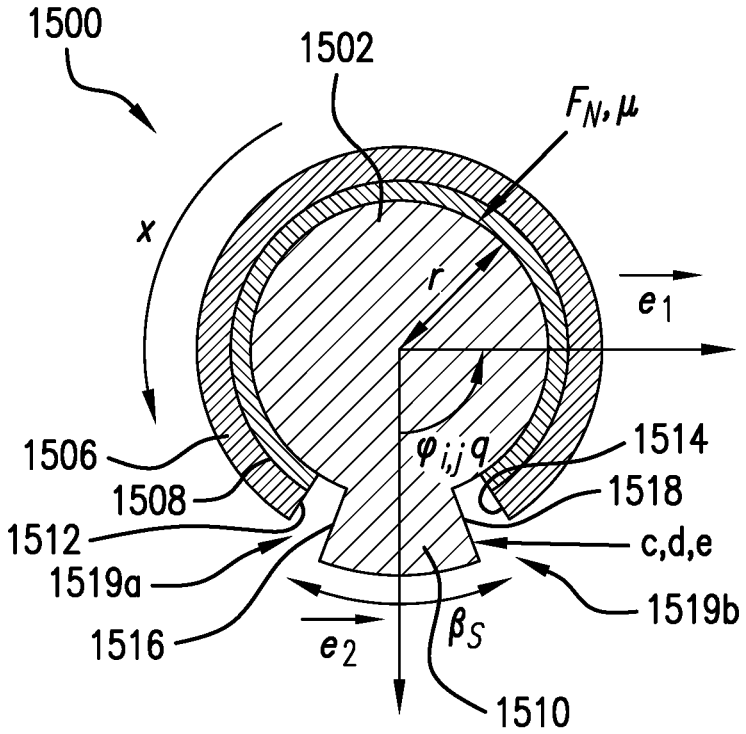
FIG. 15B is a cross-sectional view of the shock-friction damper system of FIG. 15A.

Turning now to FIGS. 15A-15B, schematic illustrations of a shock-friction damper system 1500 in accordance with an embodiment of the present disclosure is shown. FIG. 15A is a side elevation view and FIG. 15B is a cross-sectional view of the shock-friction damper system 1500 in cross-section perpendicular to a longitudinal axis of the downhole component. The cross-section view is perpendicular to a longitudinal axis of the string. In FIGS. 15A-15B, labels are provided indicating the various aspects of Equation (2), above. The shock-friction damper system 1500 includes a downhole component 1502 and a damper assembly 1504 arranged relative to the component 1502. The downhole component is also referred to herein as a structure or component body. The downhole component 1502 may be a part of a BHA or other downhole tool, downhole sub, downhole string, bit, or other structure disposed or deployed downhole. The damper assembly 1504 includes a damper element 1506 and a friction damping layer 1508. The damper element 1506 may be configured with a specific weight or mass and the friction damping layer 1508 is configured to frictionally contact an exterior surface of the downhole component 1502. In some embodiments, the damper element 1506 and the damping layer 1508 may form one integral or unitary part or component. In some embodiments, the damping layer 1508 may define or form a surface of the damper element 1506 in frictional contact with the downhole component 1502. In some embodiments, the damping layer 1508 may be made from a material that is different than a material of the downhole component 1502.

In operation, below a damping threshold, the damper element 1506 will move (slide, rotate, translate, etc.) with the component 1502 due to friction contact between the damper element 1506 and the component 1502. Above the damping threshold, the damper element 1506 will move relative to the component, causing a damping effect. As the damper element 1506 slidingly rotates about the component 1502 along the friction damping layer 1508, vibrations of the system may be damped.

The component 1502 includes a stop 1510 arranged at an axial position along the component 1502 that aligns with the damper assembly 1504. The stop may be referred to herein as a shock element. The stop 1510 may be integrally formed with the downhole component 1502 or may be attached to the downhole component 1502 using any suitable attachment means, such as, without limitation, screwing, gluing, welding, or clamping. The damper element 1506 is a partial ring that wraps about the component 1502 and has a first end 1512 and a second end 1514 that are spaced apart from the stop 1510 during normal operation. The length of a first circular arc on the circumference of the downhole component 1502 between the first end 1512 and the stop 1510, and the length of a second circular arc between the second end 1514 and the stop 1510, defines the backlash 1519 (illustratively shown as 1519*a*, 1519*b*, and collectively referred to as backlash 1519). The backlash 1519, or extension or gap extension, is the sum of the length of the first circular arc (first backlash portion) and the second circular arc (second backlash portion). That is, the backlash 1519 is the sum of the arcuate lengths between the ends 1512, 1514 and the associated contact surfaces of the stop 1510 (i.e., the gaps or spaces between the surfaces).

At a shock threshold, the damper element 1506 will move relative to the component 1502 sufficiently such that one of the first end 1512 and the second end 1514 will contact a respective surface 1516, 1518 of the stop 1510 and impart a shock or impact to the stop 1510. The surface of the stop 1510 is also referred to herein as a contact or contact surface. A first surface 1516 of the stop 1510 faces and contacts the first end 1512 of the damper element 1506 and a second surface 1518 of the stop 1510 faces and contacts the second end 1514 of the damper element 1506. When the shock occurs, the first end 1512 of the damper element 1506 contacts the first surface 1516 of the stop 1510 or the second end 1514 of the damper element 1506 contacts the second surface 1518 of the stop 1510. This impact will cause a disruption of vibrations of the component 1502, such as described above. It will be appreciated that the movement of the component 1502 (and stop 1510 thereof) and the damper element 1506 is a relative movement between the two elements.

During the sticking phase, the damper element 1506 moves (rotates) with the downhole component 1502 (string rotation). During the sliding phase, the damper element 1506 enters a rotational oscillation relative to the downhole component 1502 around an initial relative displacement or position due to torsional vibration of the downhole component 1502. In one optional initial relative position of the damper element 1506, the whole backlash 1519 (whole gap extension) may be either between the first end 1512 of the damper element 1506 and the first contact surface 1516 of the stop 1510 or between the second end 1514 of the damper element 1506 and the second contact surface 1518 of the stop 1510. In this example damper element position/configuration, the whole backlash extension $2*\beta_s$ (backlash 1519) is at one side of the damper element 1506 or stated another way, is on one side of the stop 1510 and the other side of the stop 1510 is in contact with an end of the damper element 1506. In another example damper element position, a first portion 1519*a* of the backlash 1519 (e.g., a first portion of the gap) is between the first end 1512 of the damper element 1506 and the first surface 1516 of the stop 1510, as shown in FIG. 15B. Similarly, in this initial position, a second portion of the backlash 1519*b* (e.g., a second portion of the gap) is between the second end 1514 of the damper element 1506 and the second surface 1518 of the stop 1510, as shown in FIG. 15B. In this initial damper element position, the backlash extension splits up between the first and second portion of the backlash. The damper element 1506 may initially be in a middle position between the first and second contact surfaces 1516, 1518 of the stop 1510 (e.g., half the circular arc length between the first contact surface and the second contact surface, leaving out the circular arc coved by the stop element), close to the position as shown in FIG. 15B. In the damper element middle-position the backlash extension splits equally into the first backlash portion 1519*a* and the second backlash portion 1519*b*, with arcuate lengths of the first backlash portion 1519*a* and the second backslash portion 1519*b* being equal ($|\beta_s|$). The maximal relative movement of the damper element 1506 in one rotational direction around the downhole component 1502 is then $|\beta_s|$.

It will be appreciated that the two described initial positions of the damper element relative to the backlash (or split thereof) is for explanatory and illustrative purposes, and the present disclosure is not intended to be so limited. That is, any other split of the first backslash portion and the second backslash portion are possible, depending on the initial relative position of the damper element 1506 on the circumference of the downhole component 1502 when the sliding regime starts. The first backslash portion extension and the second backslash portion extension will sum up to 2*βs. The backlash, as described in this application, is the circular arc of the circumference of the component that is not covered (or excluded) by the damper element 1506 and the stop 1510. That is, the backlash 1519 is defined as or equal to the [length of the circumference of the component 1502]—[length of the circular arc of the damper element 1506]—[length of the circular arc protected by the stop 1510]. The backlash 1519 may also be described as the maximal relative movement possible of the damper element 1506 along the circumference of the component 1502. The backlash 1519 may be measured in [rad], angular degrees, or mm.

It will be appreciated that the stop 1510 is configured to stop a rotational movement of the damper element 1506 relative to a surface of the downhole component 1502. The force that the damper element 1506 applies on the stop 1510, and that causes the shock, is a tangential force, wherein tangential refers to a tangential direction of the circumference of the downhole component 1502. The damper element 1506 is a curved member having a radius or curvature that substantially matches an external surface of the downhole component 1502. It will be appreciated that the damper element 1506, of embodiments of the present disclosure, is not a plane member. In one embodiment, the stop 1510 may be formed from more than one stop element (e.g., individual stops at the contact surfaces 1516, 1518 with a gap therebetween, which the damper element does not enter). The function of the stop is to prevent the damper element from moving along a specific circular arc length of the circumference of the downhole component. In one embodiment, the damper element circular arc length may be larger than the circular arc length between the two contact surfaces 1516, 1518 on the stop element (e.g., similar to that shown in FIG. 15B). In another embodiment the damper element circular arc length may be smaller than the circular arc length between the two contact surfaces 1516, 1518 on the stop element (e.g., the stop has an arcuate length equal to the damper element 1506 in FIG. 15B and the damper element has an arcuate length equal to the stop 1510 in FIG. 15B). In yet another embodiment, the damper element circular arc length may be equal to the circular arc length between the two contact surfaces 1516, 1518 on the stop element. In each of the above described configurations, the backlash length may be the same for each embodiment, or may be varied with larger or smaller backlash arcuate lengths being set to achieve, for example, a desired shock force.

In accordance with embodiments of the present disclosure, the stop element may take various shapes and/or be formed of various structures and/or sub-components. The stop element may have the form of a circular arc with contact surfaces that have a normal vector that is parallel to a tangent of the circumference of the downhole component at the circumferential location (component) of the contact surface. In an alternative embodiment, the stop element may have a normal vector that is inclined to the tangent of the circumference of the downhole component at the circumferential location (component) of the contact surface. In yet another embodiment, the stop may not have a plane contact surface but a curved contact surface. In general, every element qualifies as stop element that creates a stop to the movement of the damper element along the circumference of the downhole component.

In accordance with some embodiments of the present disclosure, the damping systems may be configured to operate or activate at one or more predefined vibrational thresholds. For example, as noted above, a damping threshold may be set for the system to allow for damping of vibration through friction damping, hydraulic damping, and the like. The damping threshold may define the onset of the sliding phase of the damper element (e.g., FIG. 14) and the onset of energy dissipation through the damping mechanism. In some systems, a shock threshold may be set into the system such that when the system or structure is subject to vibrations at or above the shock threshold, a damping system may impart a shock, as described herein. The shock threshold defines the occurrence of the first shock (FIG. 14). That is, the modal amplitude of a specific system (BHA, borehole parameter, damper inertia, angular frequency of the mode, position of the damper in the drill string, etc.) that causes the damper element to hit the stop the first time after the sliding regime starts. Typically, the damping threshold will be less than the shock threshold, although such difference is not required. Further, some systems may be configured with a damping system that activates based on a single threshold, such as only a damping threshold or only a shock threshold, with the damping (e.g., friction) or shock being the mechanism for vibration damping and/or disruption. In other embodiments, the damping systems may be configured with both thresholds, such that below a damping threshold no damping occurs, above the damping threshold the damping achieved by relative movement or other damping principle may be activated, and still further if a shock threshold is reached or exceeded, a shock damping may be activated. Although described as thresholds, in practice the damping or shock-damping may not occur at the specified thresholds. This may be due to the components not being free to move relative to each other. That is, the damping will occur (particularly the shock) when there is free movement between the damper element and the downhole component.

Figure 16A:
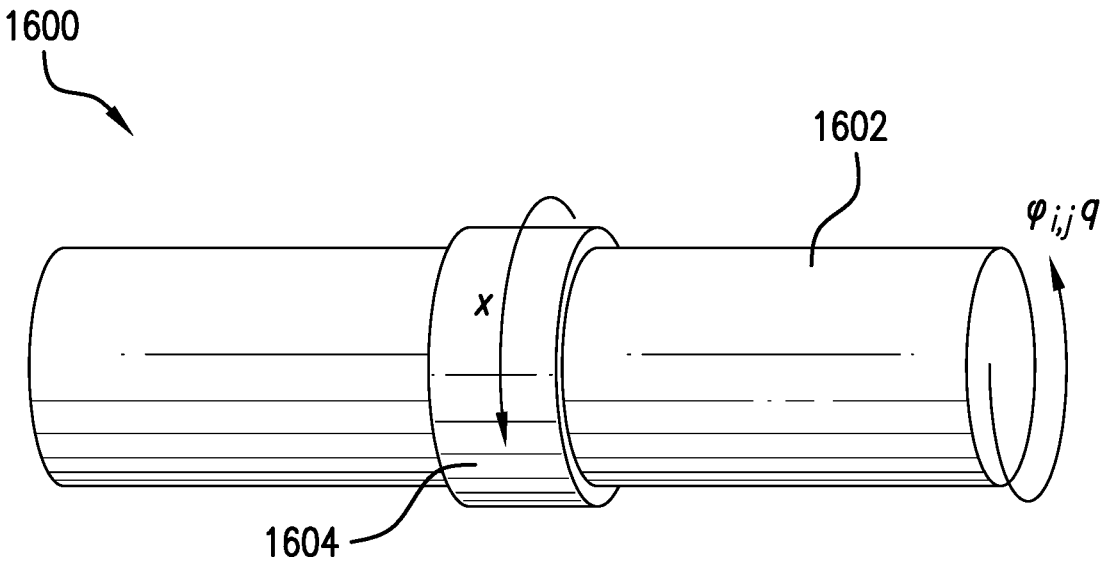
FIG. 16A is a side schematic illustration of a shock-viscous damper system in accordance with an embodiment of the present disclosure.
Figure 16B:
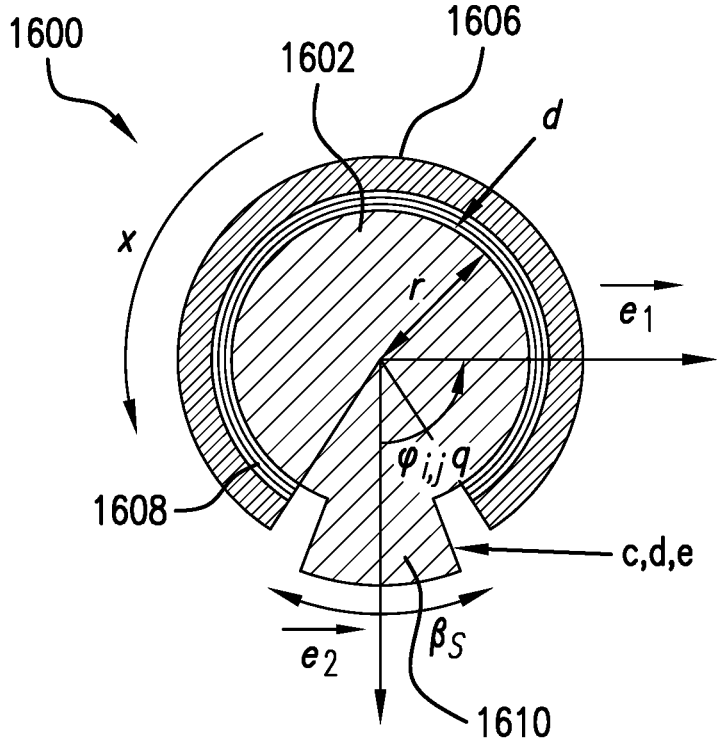
FIG. 16B is a cross-sectional view of the shock-viscous damper system of FIG. 16A.

Turning now to FIGS. 16A-16B, schematic illustrations of a shock-viscous damper system 1600 in accordance with an embodiment of the present disclosure is shown. FIG. 16A is a side elevation view and FIG. 16B is a cross-sectional view of the shock-viscous damper system 1600. The cross-sectional view is perpendicular to a longitudinal axis of the string. The shock-viscous damper system 1600 includes a component 1602 and a damper assembly 1604 arranged relative to the component 1602. The damper assembly 1604 includes a damper element 1606 and a viscous damping layer 1608. The damper element 1606 may be configured with a specific weight or mass and the viscous damping layer 1608 is configured to viscously contact an exterior surface of the component 1602, and thus move relative to the component 1602 at specific or predefined vibrations.

In operation, below a damping threshold vibration, the damper element 1606 will move (rotate, translate, etc.) with the component 1602 due to contact between the damper element 1606 and the component 1602. At or above the damping threshold, the damper element 1606 will move relative to the component, causing a damping effect. As the damper element 1606 slidingly rotates about the component 1602 along the viscous damping layer 1608, vibrations of the system may be damped. That is, energy will be dissipated due to viscous friction effects. Similar to the above described embodiment, the component 1602 includes a stop 1610 arranged to interact with the damper element 1606. The damper element 1606 is a partial ring that wraps about the component 1602. At or above a shock threshold, the damper element 1606 will move relative to the component 1602 sufficiently such that the damper element 1606 will contact or impact the stop 1610 to impart a shock. This impact will cause a disruption of vibrations of the component 1602, such as described above. Energy will be dissipated due to a shock induced velocity increase of the damper element 1606 or an energy transfer between oscillation modes of the component 1602.

Figure 17:
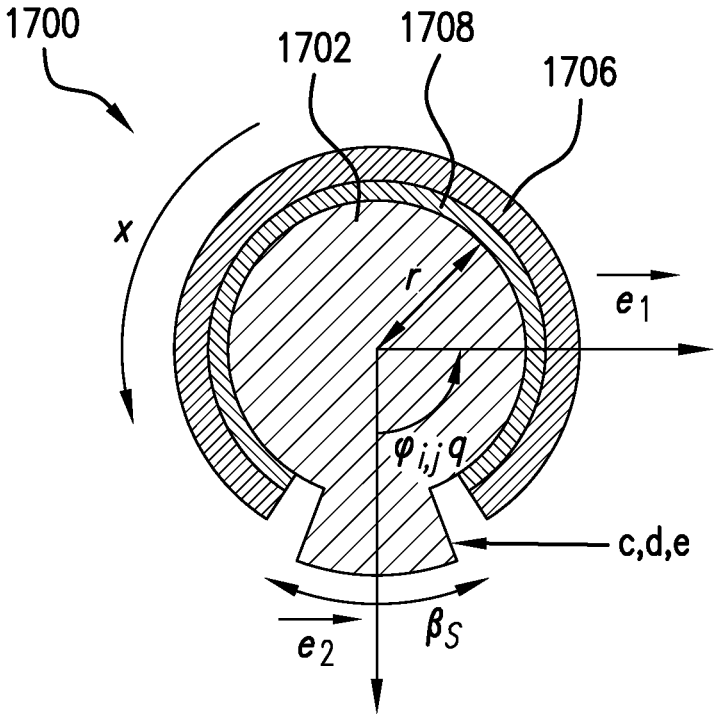
FIG. 17 is a schematic cross-sectional illustration of a shock-piezo damper system in accordance with an embodiment of the present disclosure.
Figure 18:
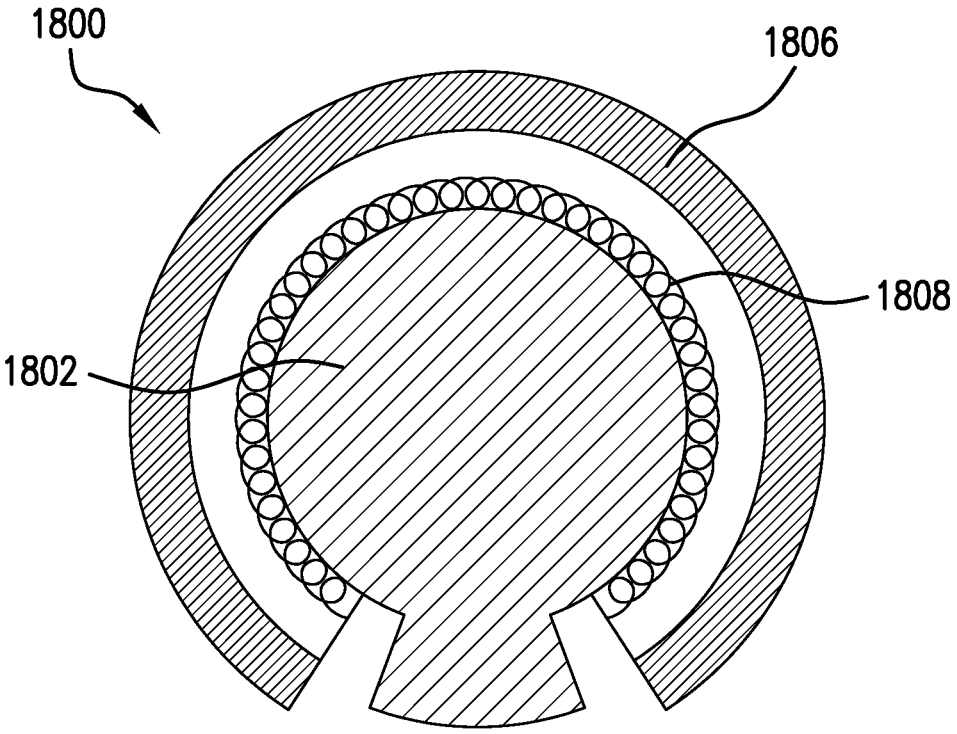
FIG. 18 is a schematic cross-sectional illustration of a shock-electromagnet damper system in accordance with an embodiment of the present disclosure.

FIGS. 17-18 illustrate different configurations for shock-damping systems in accordance with the present disclosure. FIG. 17 illustrates a shock-piezoelectric damper system 1700, where a damping assembly includes a damper element 1706 arranged with a piezoelectric-damping layer 1708 between the damper element 1706 and a downhole component 1702. FIG. 18 illustrates a shock-electromagnet damper system 1800, where a damping assembly includes a damper element 1806 arranged with an electromagnet damping layer 1808 between the damper element 1806 and a downhole component 1802. In the shock-electromagnet damper system 1800, the electromagnet damping layer 1804 may be formed with electromagnets and/or permanent magnets.

The above described shock-damping systems may be implemented at various locations along a tool, BHA, and/or tool string. For example, the shock-damping systems of the present disclosure may be arranged at, on, or proximate to a drill bit or other disintegrating device (e.g., the distal end of a drilling string). In some configurations, the shock-damping systems may be arranged at one or more locations along a BHA or other downhole tool or system. In accordance with some embodiments, the damping systems described herein may be arranged in a downhole steering device, such as a rotary steerable system. Furthermore, damping systems as described herein may be arranged above or below a downhole formation evaluation device along a tool string or the like. Further still, in some embodiments, the shock-damping systems may be arranged along a drill string of the system (e.g., uphole from a BHA). It will be appreciated that multiple shock-damping systems may be arranged along a single string, or along a single BHA, and the shock-damping systems may incorporate one or more of the above described configurations for performing damping and shock damping, without departing from the scope of the present disclosure.

For example, and without limitation, the shock-damping systems described herein may be arranged at a bit, within a BHA, above the BHA (e.g., uphole from the bottom of a drilling string), etc. Further, the location may be eccentric or centric relative to a tool axis. For example, if a drilling system has a central line (axis) and the central line is the main axis of the drilling system in direction of the well (e.g., the longitudinal axis of the string or the component, as described herein), then a location is centric if it is on central line or very close to this central line. A location is eccentric if it is at the outer circumference or radially close thereto. It will be appreciated that the specific radial distance between the central line and the outer circumference at which a location switches from centric to eccentric may not be well defined. However, in general, if a component is arranged in a tool body it may be considered centric, and if a component is in a probe within the tool body it may be considered eccentric. The systems may be incorporated into a tool body or arranged with or on a probe of a downhole system or BHA. The disclosed shock-damping systems may be used for wired BHAs and/or non-wired BHAs, may be arranged as tool extensions or as a dedicated tool itself, and/or may be arranged at one or more locations along the downhole system.

Figure 19:
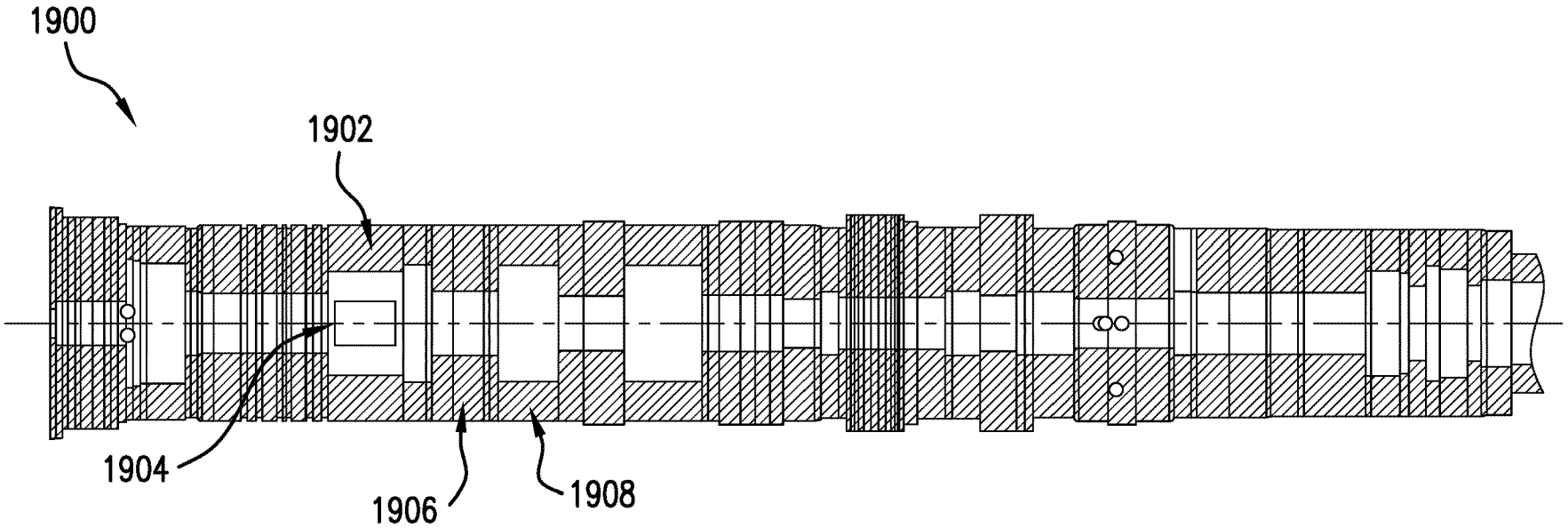
FIG. 19 is a schematic illustration of a downhole system having multiple different shock-damping systems installed thereon, illustrating different locations of such shock-damping systems in accordance with the present disclosure.

Referring to FIG. 19, a schematic illustration of a downhole system 1900 is shown. The downhole system 1900 may be arranged at an end of a drill string and may include a bit or disintegrating device on an end thereof. FIG. 19 illustrates different locations of application and installation of shock-damping systems of the present disclosure. For example, at a first position 1902, a shock-damping system may be installed at an eccentric position relative to the downhole system 1900 (e.g., offset from an axis of the downhole system 1900). At a second position 1904, a shock-damping system may be installed that is centric relative to the downhole system 1900. Location 1906 represents a dedicated damper tool, where the shock-damping system is a sub or other component along the string of the downhole system 1900. Location 1908 represents the inclusion of a shock-damping system installed within or on an existing tool, sub, or portion of the downhole system 1900. As such, location 1908 represents an installation of a shock-damping system on or with a tool that has other functionality and/or purpose other than damping vibrations.

Figure 20:
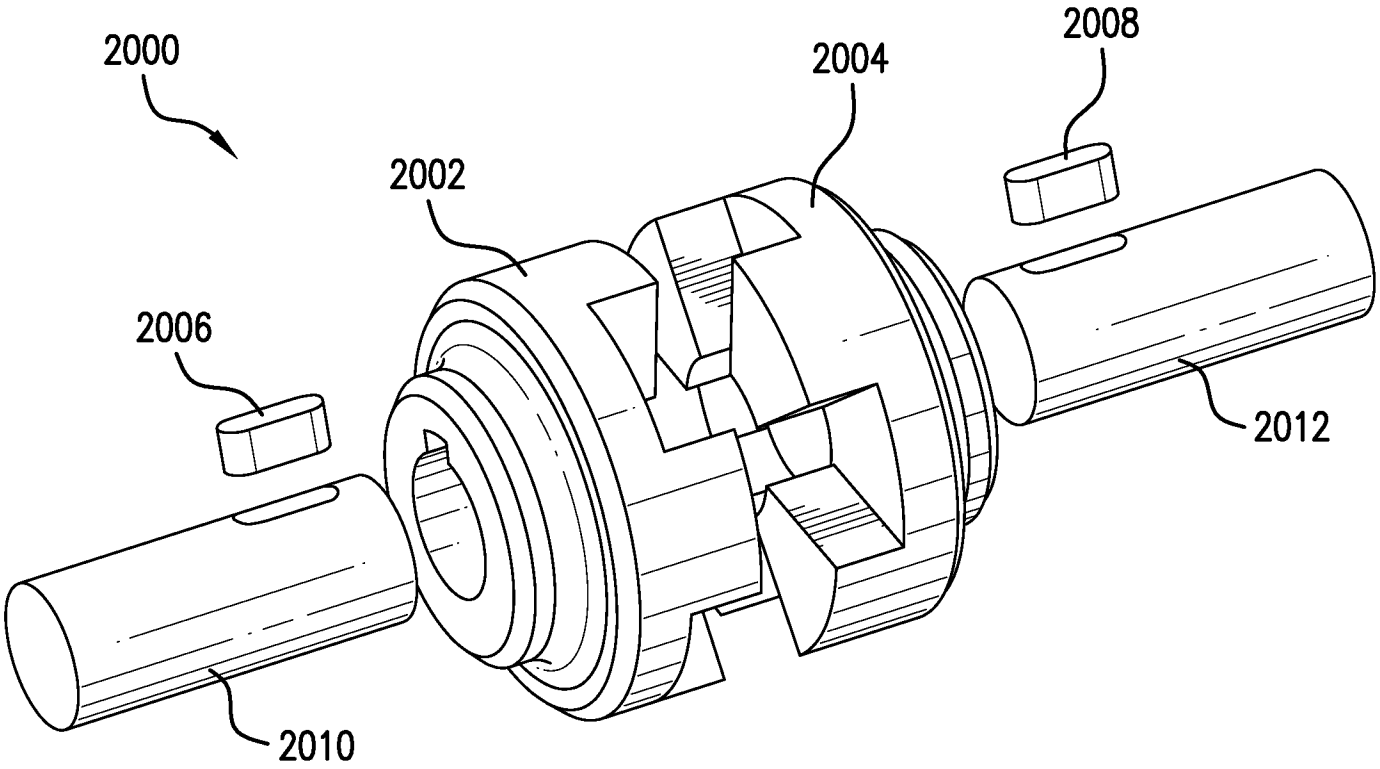
FIG. 20 is a schematic illustration of a multi-shock shock-damping system in accordance with an embodiment of the present disclosure.

Turning now to FIG. 20, a schematic illustration of a shock-damper system 2000 in accordance with an embodiment of the present disclosure is shown. The shock-damper system 2000, in this configuration, is arranged to be a separate or distinct damper sub in a downhole system, although the principals of this system may be implemented in other configurations and arrangements as described herein. The shock-damper system 2000 includes a first tangential shock-damper element 2002 and a second tangential shock-damper element 2004 arranged to rotate relative to each other. Each of the tangential shock-damper elements 2002, 2004 include structures that can rotate relative to each other contact each other to impart a shock at desired or predetermined vibration levels or modes. The shock-damper system 2000, as shown, includes fitting keys 2006, 2008, which are arranged within shafts 2010, 2012 to allow rotational locking of the tangential shock-damper element on the shafts 2010, 2012. It will be appreciated that other directional shock dampers may be implemented without departing from the scope of the present disclosure, including but not limited to, axial dampers and lateral dampers, with the dampers arranged to move in a specific direction to impart a shock to damp vibration within a respective tool or system.

In accordance with some embodiments, the contact surfaces of the shock dampers of the present disclosure may include a coating or other feature to ensure that damage does not occur during the shock contacts. For example, in some embodiments, a surface of the shock damper (e.g., the surfaces of the stop) may include a foam coating, a foam layer, or a layer of other material (e.g., polymer, rubber, elastomer, etc.) that can absorb or reduce the shock imparted such that mechanical damage does not occur and a transmission of energy can be maximized.

The above described shock damper systems have been passive. That is, the structure and configuration of the shock damper is such that upon reaching a shock threshold vibration, the shock component will move freely relative to a component, and due to this free motion, surfaces of the two elements may come into contact, thus imparting a shock to disrupt and damp vibrations in the system. However, embodiments of the present disclosure are not limited to passive damping. In some embodiments, the shock damper systems may be active. That is, an active or actuated contact may be initiated upon reaching or exceeding a shock threshold vibration of the system or structure.

Such active shock generators can include, without limitation, an actuated hammer or other driven mass, a piezoelectrical generator, a pneumatic generator, an electric motor driven mass, a chemical generator (e.g., explosive), and/or thermal generators. Each of these active shock generators results in contact between the shock generator and a surface of a downhole system, similar to that described above. In some embodiments, a non-contact shock generator may be employed. Such non-contact shock generators may include electromagnets and/or the use of pressurized fluids (e.g., liquids, gases, plasmas).

Figure 21:
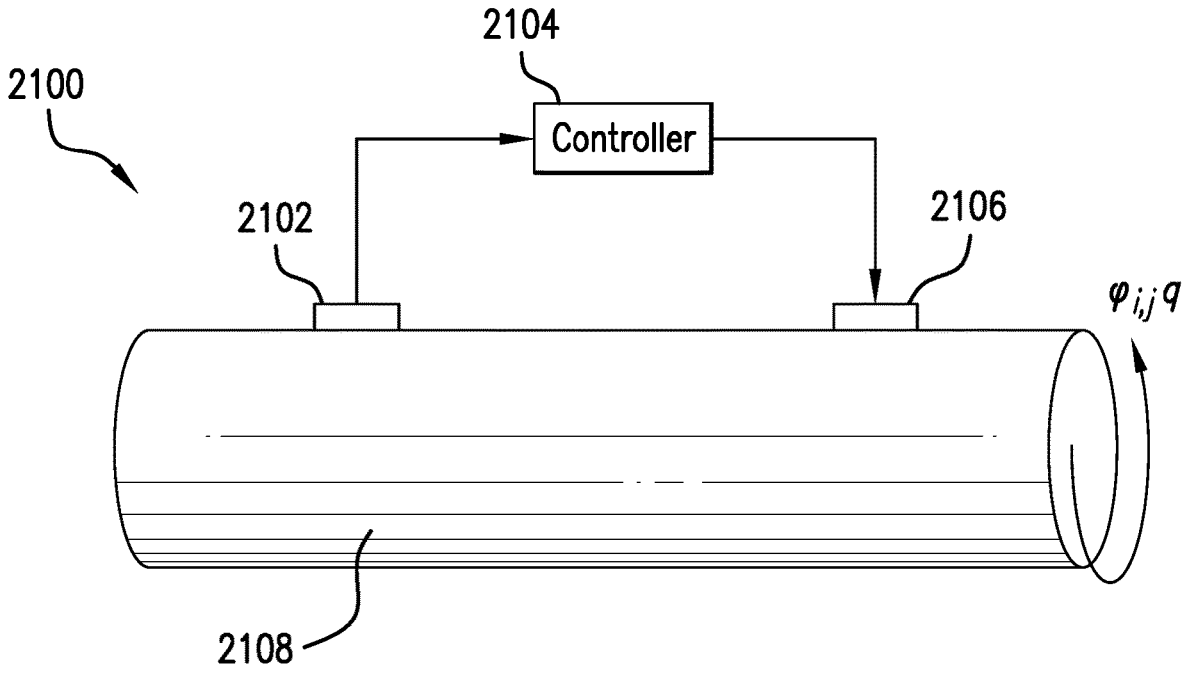
FIG. 21 is a schematic illustration of an active shock-damping system in accordance with an embodiment of the present disclosure.

Turning now to FIG. 21, a schematic illustration of an active shock generator system 2100 in accordance with an embodiment of the present disclosure is shown. The active shock generator system 2100 includes a sensor 2102, a controller 2104, and a shock-damper assembly 2106. The sensor 2102 and the shock-damper assembly 2106 may be attached to, mounted on, or coupled to a structure 2108 (e.g., drill string, bit, BHA, sub, or the like). The sensor 2102 is configured to detect position, velocity, and/or acceleration of both the structure 2108 and the shock-damper assembly 2106. The sensor 2102 is configured to monitor vibrations (e.g., torsional oscillation) of the structure and the damper element. Using modal amplitude and phase of the detected torsional oscillation, a mass of the shock-damper assembly 2106 may be excited (e.g., actuated) at a certain modal amplitude and phase to influence the vibration of the structure 2108. For example, 180° phase, force amplitude is chosen to eliminate energy of the structure completely. The controller 2104 may be configured to monitor a signal from the sensor 2102 and analyze such signal to determine when active damping actions should be taken. If an action should be taken, the controller 2104 is configured to transmit a control signal to the shock-damper assembly 2106 to perform a damping action (e.g., impart a shock to the system).

It will be appreciated that the controller 2104 of FIG. 21 may be incorporated into and used with any of the other described embodiments and embodiments in accordance with the present disclosure. That is, both passive and active damping may be achieved through use of a controller that is in communication with the damper system and/or sensors associated therewith. Such controllers may be operably coupled to and/or in communication with one or more elements or components of the damper systems to enable control and/or actuation thereof. In some embodiments, a controller may be arranged in connection to collect data associated with operation of the damper system. In accordance with some embodiments, a dedicated or discreet controller associated with the damper system may be employed. In other embodiments, a general purpose or other downhole controller may be used with the shock-damper assemblies. That is, although the embodiment of FIG. 21 includes the controller as illustratively shown, any of the embodiments described herein may incorporate such a controller as necessary and desired for the specific application and implementation.

Figure 22:
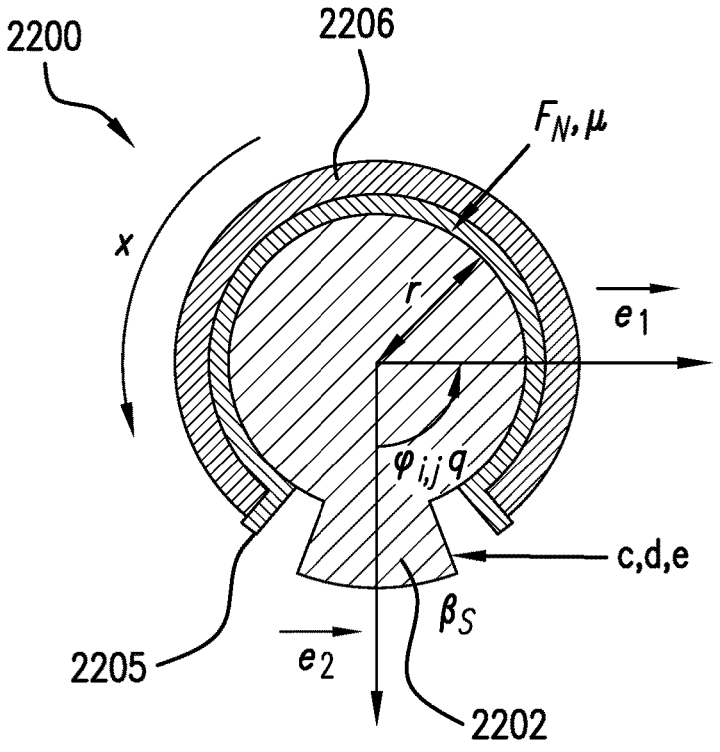
FIG. 22 is a schematic illustration of a semi-active shock-damping system in accordance with an embodiment of the present disclosure.

FIG. 22 provides a schematic illustration of a specific type of active shock generator system 2200. In this active shock generator system 2200, a damper element 2206 is installed about a component or structure 2202, with a stop 2210 arranged thereon (either integral or attached thereto). In this case, the circumferential extent of the damper element 2206 about the component 2202 may be passively controlled by the dimensions of the stop 2210 and/or actively controlled using an adjustable element 2205 that can change the arclength or width of the damper element 2206. The adjustable element 2205 is configured to change, adjust, or otherwise control or set the length of the backlash (gap extension) of the shock generator system 2200. Adjustment of the adjustable element 2205 of the shock damping system adjusts or modifies the shock threshold and/or the onset of the first shock. The backslash can be adjusted to be larger in length (e.g., larger in a circular arc length) or may be adjusted to be shorter in length (e.g., smaller in a circular arc length). The adjustment of the backlash allows selection of the modal amplitude and phase of the torsional oscillation when the shock occurs based on sensor readings performed by a controller or the like (e.g., controller 2104 shown in FIG. 21). In such configurations, the arc length defined by the adjustable element 2205 may be controlled or set through a control mechanism implemented by such a controller. In other configurations, for example, the arc length may be manually set at the surface prior to deployment downhole.

In some embodiments, the adjustment element 2205 may be adjusted continuously while the torsional vibrations of the component changes or may be adjusted (or set) once (e.g., at the beginning of a drilling run) and may then be kept constant. In such a continuous adjustment, the adjustment element 2205 may be actively controlled (e.g., hydraulically, pneumatically, electronically, etc.) by a downhole or surface controller or the like. In some embodiments of the present disclosure, the adjustment of the adjustment element 2205 may be performed based on a specific time schedule or may be triggered by a certain torsional oscillation condition detected by a controller associated with the shock generator system 2200. The control of the backlash length may be performed, in part, based on various sensors and other components and/or information associated with rotation of the downhole tool and vibrations thereof. Further, in some embodiments, the controller may include a memory and/or look-up table used to cause adjustment of the adjustment element 2205 based on information obtained from the sensors or from other sources (e.g., telemetry signals from the surface).

The adjustable element may take various forms or shapes that are suitable to modify the length of the backlash. The adjustable element may be implemented in the damper element or may be separate from the damper element. In some embodiments, the adjustable element may be attached or integrated in the stop of the system. The adjustable element may use various adjustment mechanisms, including, without limitation, piezoelectric mechanisms, electromagnetic mechanisms, hydraulic mechanisms, motor-based mechanisms (e.g. a spindle), or any other suitable type of mechanism. The illustrative configuration is merely provided for example and illustrative purposes and other types of damper/shock systems may be employed without departing from the scope of the present disclosure.

In accordance with some embodiments of the present disclosure, the length of the backlash may be adjusted or set at a surface location prior to deploying the drill string (or component) into a borehole and conveyed downhole. In other embodiments, the length of the backlash may be adjusted downhole or even while drilling the borehole (i.e., real-time adjustment). The adjustment may be done by installing in the shock-damper system an adjustment element of a fixed size (e.g., fixed arc length). Alternatively, the adjustment element may be an active element and may be adjustable either downhole or at the surface. The adjustment may be performed to adjust the shock-damper system to an optimized backlash extension (gap extension) that ensures the shock occurrence at the desired modal amplitude and phase (shock threshold). In accordance with some embodiments, the optimized backlash extension may be determined using a simulation or a model. The simulation or model may be used by a controller at the surface or at a downhole location to adjust the backlash (e.g., in real time based on the simulation/model). The simulation or model may allow for calculation of the backslash depending on torsional oscillation mode properties, such as for example angular frequency and modal amplitude of the torsional oscillation, and to properties of the damper system, such as for example inertia of the damper element, the mean radius of the friction contact area, the friction torque or normal force, the damping mechanism (e.g. friction coefficient for a friction contact)

$$\left(\beta_s \sim \frac{F_N \mu r \pi}{2 J \omega_i^2}\right),$$

or the like.

In accordance with some embodiments, the simulation or model may also account for an initial relative displacement of the damper element relative to the component or structure or a feature thereof (e.g., relative to a stop). The simulation or model may be based on purely synthetic data and modeling, experimental measurements in a lab, and/or based on historical data from earlier drilled boreholes. The simulation or model may include a model of one of the disintegration device, the drill string or BHA, and the borehole. To adjust the adjustment element, a current or voltage may be provided, supplied, or applied to the adjustment element. Such a current or voltage can be controlled by a controller associated with the damper system and/or associated with one or more other downhole systems. The electrical energy required to perform the adjustment may be provided by a surface power supply, by a battery (downhole or at surface), or a downhole power generator, such as a turbine driven generator that uses flow energy of a drilling fluid.

In accordance with some embodiments of the present disclosure, the backlash may be optimized for a specific application. For example, the specific application(s) may include, without limitation, specific drill string or BHA configurations, a position of the shock-damper system in the drill string or the BHA, potential other damper systems in the drill string or BHA, downhole formation(s) to be drilled, borehole parameters (e.g., trajectory (inclination), diameter, etc.), bit type, and/or damper properties (e.g., damping mechanism (friction, hydraulic, electrical, electromechanical, piezoelectrical, etc.), damper element inertia, damper system dimensions, backlash extension, an initial relative displacement, etc.). In some embodiments of the present disclosure, instead of adjusting the backlash extension, the normal force between the damper element and the component or friction torque may be adjusted (friction damper) by a force adjustment element. The adjustment of the normal force or the friction torque may be achieved by use of a force adjustment element that may include a controllable force that pulls the damper element ends (FIG. 15B) to each other by using a swivel-based system or a spring force-based system. Alternatively, a piezoelectric element or any other suitable active member may be deployed to adjust the normal force. For example, the piezoelectric layer 1708 in the embodiment of FIG. 17 may be used to increase the tension between the component 1702 and the damper element 1706. The piezoelectric layer may be controlled by controller or the like (e.g., controller 2104 of FIG. 21).

Various forms of damping and shock may be implemented with embodiments of the present disclosure. In some embodiments, hydraulic damping may be used. In some such embodiments, a viscous fluid (e.g., viscous fluid in one or more chambers) may be arranged and installed in similar locations as described above. In some such applications, the (shear) stresses in the fluid between an inertia ring/mass and the component may be selected to achieve a (damping) force that is tangential to the tangential acceleration and associated harmonic movement to damp vibration (e.g., HFTO). In the case of ring shearing, the fluid can provide a damping force between the inertia ring and the component. In this case, the ring may require a closed housing and, potentially, a well-defined geometry of the gaps between the ring and the housing that could also be achieved by a cover sleeve. In hydraulic damping, the viscous damping forces are sensitive to parameter changes of the fluid gaps and the viscous fluid. Therefore, a temperature insensitive fluid may be preferred. Fluids with different shear stresses as a function of the shear rate can be used to achieve a beneficial behavior. Some such example fluids include, without limitation, Newtonian fluids, non-Newtonian fluid (e.g., dilatant, shear-thickening fluids, shear-thinning fluids, etc.), pseudoplastic, Bingham plastic, Bingham pseudoplastic fluids, etc.

In some embodiments, magnetic damping can be employed. Magnetic damping may be achieved by a permanent magnet (e.g., mounted on an inertial ring or mass element) that is allowed to move relative to a coil and can be used to damp vibrations of a system. Depending on the magnetic principle, the damping force characteristic is similar to hydraulic (e.g., electromagnetic damper, such as eddy current damper) or friction (Hysteresis) forces. In some such configurations, the force would act in the direction of the tangential acceleration or any other direction that is able to lead to damping in a torsional direction or the direction that should be damped.

In some embodiments, piezoelectric damping principles may be employed to prevent or mitigate vibrations in downhole systems. A piezoelectric material that is connected to an inertia ring or to a tangential mass on one side/end and to the component or structure on the other side/end can be used. The electrodes of the piezoelectric material can be connected to a circuit incorporating coils, resistors, and capacitances or semi-active or active electronic components. A combination of the electrical components can be used to achieve beneficial damping characteristics between the damper systems and the downhole components/system or structure. A circuit may be configured to a natural frequency of the system to work as a tuned mass damper (i.e., for one or more desired modes). In some configurations, a resistor could be arranged to directly dissipate energy if the piezoelectric stack is deformed by relative forces between a mass element and the component. Additionally, in some configurations, the stiffness of the piezoelectric material and an inertia ring mass (damper element) could be tuned to a specific frequency as well. In some embodiments, the electrodes of the piezoelectric material can be arranged to damp torsional vibrations. The direction of the damping forces can be different from the direction of the electrodes using the beneficial transformation effect from mechanical force-to-electrical signal that is suggested by the design of the piezoelectric actor. Well-known effects of piezoelectric coefficients are $D_{33}$ (electrodes in a direction of the force), $D_{31}$ (orthogonal to a direction of the force), and $D_{15}$ (shear stresses). The piezoelectric material can be placed to optimize or control the coupling between the mechanical and the electrical system for a specific mode or multiple mode shapes that are critical to downhole vibration (e.g., HFTO). Further, various different materials that transfer mechanical force or stress or related loads into electrical signals can be used without departing from the scope of the present disclosure.

In accordance with embodiments of the present disclosure, the shock-damper systems may include components formed of specific materials having properties to increase the potential damping and/or shock/impact. For example, material damping can be achieved passively through the damping properties of high damping materials. Some such materials may include, without limitation, polymers, elastomers, rubber, etc. as well as the damping effect of multi-functional materials such as shape memory alloys. The material properties of some materials, such as shape memory alloys, can be actively influenced or controlled to achieve greater damping effects.

Other damping and/or shock configurations are possible without departing from the scope of the present disclosure. For example, negative capacitances and semi-active components using switching techniques may be employed. Additional damping techniques and components may be used, and the above described embodiments and variations are provided for illustrative and explanatory purposes and are not intended to be limiting. All of the damping principles described herein can be adjusted to work as a tuned mass damper by adding mechanical springs adjusted to a specific frequency and by adding damping and/or shock/impact of any type. Further, one or more of the damping principles described herein (or other methods/mechanisms) can be combined in a multi-principle configuration. For example, ring-type inertia dampers can be combined with tangential mass inertia dampers installed within or attached to blades of a disintegration device. Furthermore, magnetic, hydraulic, friction, piezoelectric, and material damping forces and principles could be combined to achieve a robust damping effect, such as, for example, with respect to temperature.

Embodiment 1: A system for damping torsional oscillations of downhole systems, the system comprising: a downhole component configured to be disposed downhole; and a shock-damping system at least one of on or in the downhole component, the shock-damping system configured to reduce torsional oscillations of the downhole component by imparting a selected shock to the downhole component; wherein the selected shock is selected to generate damping of the torsional oscillations of the downhole system.

Embodiment 2: The system of any preceding embodiment, wherein the torsional oscillations include a first torsional oscillation mode, and wherein the selected shock is selected based on at least one of a modal amplitude of the first torsional oscillation mode and a phase of the first torsional oscillation mode to generate the damping of the torsional oscillations.

Embodiment 3: The system of any preceding embodiment, wherein the torsional oscillations include a second torsional oscillation mode, wherein the selected shock is selected to generate at least one of (i) a transfer of energy between the first torsional oscillation mode and the second torsional oscillation mode, or (ii) a dissipation of energy from the downhole system.

Embodiment 4: The system of any preceding embodiment, wherein the shock-damping system comprises a damper element, a shock element, and a gap including a gap extension defined between the shock element and the damper element.

Embodiment 5: The system of any preceding embodiment, wherein a size of the gap extension is based on a shock threshold, and the shock threshold is based on the modal amplitude of the first torsional oscillation mode.

Embodiment 6: The system of any preceding embodiment, wherein a size of the gap extension is based on a shock threshold and the shock threshold is based on the modal amplitude of the first torsional oscillation mode.

Embodiment 7: The system of any preceding embodiment, further comprising: a sensor arranged on the downhole component and configured to monitor torsional oscillations of the downhole component; and a controller in communication with the sensor, the controller configured to actuate the shock-damping system in response to a detected modal amplitude of the monitored torsional oscillations that exceeds the shock threshold.

Embodiment 8: The system of any preceding embodiment, further comprising an adjustable element, wherein the adjustable element is configured to adjust a size of the gap extension, the adjustable element including at least one of a piezoelectric element, a hydraulic element, a spring element, a motor element, and a spindle element.

Embodiment 9: The system of any preceding embodiment, wherein the calculation is based on one of a damping system property and a property of the first torsional oscillation mode.

Embodiment 10: The system of any preceding embodiment, wherein the damping system property is at least one of a damper element inertia, a normal force, a torque, a friction coefficient or wherein the property of the first torsional oscillation mode is an angular frequency.

Embodiment 11: The system of any preceding embodiment, wherein the downhole component comprises a longitudinal axis and a circumference in a plane perpendicular to the longitudinal axis, and the shock-damping system comprises a damper element configured to move with a relative velocity relative to the downhole component and along the circumference of the downhole component.

Embodiment 12: The system of any preceding embodiment, further comprising a shock element and a gap between the shock element and the damper element, the shock element arranged to stop the relative movement of the damper element, wherein the selected shock is imparted when the shock element stops the relative movement of the damper element.

Embodiment 13: The system of any preceding embodiment, wherein the relative movement of the damper element includes a rotational oscillation around an axis parallel to the longitudinal axis of the downhole component.

Embodiment 14: The system of any preceding embodiment, wherein the damper element extends about a portion of the circumference of the downhole component.

Embodiment 15: The system of any preceding embodiment, wherein the shock-damping system comprises a damper element arranged to move relative to the downhole component with a velocity that is a sum of a periodic velocity fluctuation having an amplitude and a mean velocity, wherein the mean velocity is lower than the amplitude of the periodic velocity fluctuation.

Embodiment 16: The system of any preceding embodiment, wherein the shock-damping system is arranged to provide one of viscous damping, piezoelectric damping, and magnetic damping.

Embodiment 17: The system of any preceding embodiment, wherein the shock-damping system comprises a damping element arranged in contact with a portion of the downhole component.

Embodiment 18: The system of any preceding embodiment, further comprising a force adjustment element configured to adjust a force between the downhole element and the damper element.

Embodiment 19: The system of any preceding embodiment, wherein the downhole component is one of a disintegrating device and a drill string.

Embodiment 20: The system of any preceding embodiment, wherein the calculation of the optimized gap extension comprises simulation of one of a disintegration device and a drill string.

Embodiment 21: The system of any preceding embodiment, wherein the gap extension is adjusted based on the calculation, the adjustment of the gap extension is performed at one of the earth surface and a downhole location during a downhole operation.

Embodiment 22: The system of any preceding embodiment, wherein the calculation of the optimized gap extension uses one of historical data, and experimental data.

Embodiment 23: The system of any preceding embodiment, further comprising a damping material, the damping material is one of a polymer, an elastomer, and a rubber.

Embodiment 24: The system of any preceding embodiment, wherein the selected shock generates an increase of the relative velocity.

Embodiment 25: A method of damping torsional oscillations of downhole systems, the method comprising: installing a shock-damping system at least one of on and in a downhole component located on a downhole string of the downhole system, the damping system configured to reduce torsional oscillations of a downhole component by imparting a selected shock to the downhole component.

Embodiment 26: The method of any preceding embodiment, wherein the torsional oscillations include a first torsional oscillation mode, and wherein the selected shock is selected based on at least one of a modal amplitude of the first torsional oscillation mode and a phase of the first torsional oscillation mode.

Embodiment 27: The method of any preceding embodiment, wherein the torsional oscillations include a second torsional oscillation mode, wherein the selected shock is selected to at least one of (i) a transfer of energy between the first torsional oscillation mode and the second torsional oscillation mode, or (ii) a dissipation of energy from the downhole system.

Embodiment 28: The method of any preceding embodiment, wherein the torsional oscillations include a first torsional oscillation mode, and the shock-damping system comprises a damper element, a shock element, and a gap including a gap extension defined between the shock element and the damper element, wherein the method further comprises: calculating a size of the gap extension to damp the torsional oscillations of the downhole system; and setting the gap extension to the calculated size.

Embodiment 29: The method of any preceding embodiment, wherein the calculation is based on a damping system property and an angular frequency of the first torsional oscillation mode.

Embodiment 30: The method of any preceding embodiment, wherein the damping system property is a damper element inertia.

Embodiment 31: The method of any preceding embodiment, wherein the damping system property is one of a normal force, a torque, and a friction coefficient.

Embodiment 32: The method of any preceding embodiment, wherein the property of the first torsional oscillation mode is an angular frequency.

Embodiment 33: The method of any preceding embodiment, wherein: the calculation of the size of the gap extension is based on a shock threshold, and the shock threshold is based on a modal amplitude of the first torsional oscillation mode.

Embodiment 34: The method of any preceding embodiment, wherein the calculation of the gap extension comprises simulation of one of a disintegration device and a drill string.

Embodiment 35: The method of any preceding embodiment, wherein the setting of the gap extension to the calculated size is performed at one of the earth surface and a downhole location during a downhole operation.

Embodiment 36: The method of any preceding embodiment, wherein the calculation of the gap extension is based on historical data or experimental data.

Embodiment 37: The method of any preceding embodiment, wherein the shock damping system comprises a damper element configured to move relative to the downhole component with a relative velocity, the method comprising generating, with the selected shock, an increase of the relative velocity.

In support of the teachings herein, various analysis components may be used including a digital and/or an analog system. For example, controllers, computer processing systems, and/or geo-steering systems as provided herein and/or used with embodiments described herein may include digital and/or analog systems. The systems may have components such as processors, storage media, memory, inputs, outputs, communications links (e.g., wired, wireless, optical, or other), user interfaces, software programs, signal processors (e.g., digital or analog) and other such components (e.g., such as resistors, capacitors, inductors, and others) to provide for operation and analyses of the apparatus and methods disclosed herein in any of several manners well-appreciated in the art. It is considered that these teachings may be, but need not be, implemented in conjunction with a set of computer executable instructions stored on a non-transitory computer readable medium, including memory (e.g., ROMs, RAMs), optical (e.g., CD-ROMs), or magnetic (e.g., disks, hard drives), or any other type that when executed causes a computer to implement the methods and/or processes described herein.

These instructions may provide for equipment operation, control, data collection, analysis and other functions deemed relevant by a system designer, owner, user, or other such personnel, in addition to the functions described in this disclosure. Processed data, such as a result of an implemented method, may be transmitted as a signal via a processor output interface to a signal receiving device. The signal receiving device may be a display monitor or printer for presenting the result to a user. Alternatively, or in addition, the signal receiving device may be memory or a storage medium. It will be appreciated that storing the result in memory or the storage medium may transform the memory or storage medium into a new state (i.e., containing the result) from a prior state (i.e., not containing the result). Further, in some embodiments, an alert signal may be transmitted from the processor to a user interface if the result exceeds a threshold value.

Furthermore, various other components may be included and called upon for providing for aspects of the teachings herein. For example, a sensor, transmitter, receiver, transceiver, antenna, controller, optical unit, electrical unit, and/or electromechanical unit may be included in support of the various aspects discussed herein or in support of other functions beyond this disclosure.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the present disclosure.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While embodiments described herein have been described with reference to various embodiments, it will be understood that various changes may be made and equivalents may be substituted for elements thereof without departing from the scope of the present disclosure. In addition, many modifications will be appreciated to adapt a particular instrument, situation, or material to the teachings of the present disclosure without departing from the scope thereof. Therefore, it is intended that the disclosure not be limited to the particular embodiments disclosed as the best mode contemplated for carrying the described features, but that the present disclosure will include all embodiments falling within the scope of the appended claims.

Accordingly, embodiments of the present disclosure are not to be seen as limited by the foregoing description, but are only limited by the scope of the appended claims.

What is claimed is:

1. A system for damping torsional oscillations of downhole systems, the system comprising:

a downhole component configured to be disposed downhole; and a shock-damping system at least one of on or in the downhole component, wherein the shock-damping system comprises a damper element arranged to move relative to the downhole component with a velocity that is a sum of a periodic fluctuation having an amplitude and a mean velocity, wherein the mean velocity is lower than the amplitude of the periodic velocity fluctuation, the shock-damping system configured to reduce torsional oscillations of the downhole component by imparting a selected shock to the downhole component;

wherein the selected shock is selected to generate damping of the torsional oscillations of the downhole system.

2. The system of claim 1, wherein the torsional oscillations include a first torsional oscillation mode, and wherein the shock-damping system includes a shock element and a gap comprising a gap extension defined between the shock element and the damper element, and wherein the selected shock is based on the gap extension and a size of the gap extension is selected based on at least one of a modal amplitude of the first torsional oscillation mode and a phase of the first torsional oscillation mode to generate the damping of the torsional oscillations.

3. The system of claim 2, wherein the torsional oscillations include a second torsional oscillation mode, wherein the size of the gap extension is selected to generate at least one of (i) a transfer of energy between the first torsional oscillation mode and the second torsional oscillation mode, or (ii) a dissipation of energy from the downhole system.

4. The system of claim 2, wherein the size of the gap extension is based on a shock threshold and the shock threshold is based on the modal amplitude of the first torsional oscillation mode.

5. The system of claim 4, further comprising:

a sensor arranged on the downhole component and configured to monitor torsional oscillations of the downhole component; and a controller in communication with the sensor, the controller configured to actuate the shock-damping system in response to a detected modal amplitude of the monitored torsional oscillations that exceeds the shock threshold.

6. The system of claim 2, further comprising an adjustable element, wherein the adjustable element is configured to adjust the size of the gap extension, the adjustable element including at least one of a piezoelectric element, a hydraulic element, a spring element, a motor element, and a spindle element.

7. The system of claim 1, wherein the downhole component comprises a longitudinal axis and a circumference in a plane perpendicular to the longitudinal axis, a shock element, and a gap is defined between the shock element and the damper element, the shock element arranged to stop a movement of the damper element relative to the downhole component and along the circumference of the downhole component, wherein the selected shock is imparted when the shock element stops the relative movement of the damper element.

8. The system of claim 7, wherein the relative movement of the damper element includes a rotational oscillation around an axis parallel to the longitudinal axis of the downhole component.

9. The system of claim 7, wherein the selected shock generates an increase of the relative velocity between the damper element and the downhole component.

10. The system of claim 1, wherein the damping element is arranged in contact with a portion of the downhole component.

11. A system for damping torsional oscillations of downhole systems, the system comprising:

a downhole component configured to be disposed downhole; and a shock-damping system at least one of on or in the downhole component, wherein the shock-damping system is arranged to provide one of viscous damping, piezoelectric damping, and magnetic damping, the shock-damping system configured to reduce torsional oscillations of the downhole component by imparting a selected shock to the downhole component, wherein the selected shock is selected to generate damping of the torsional oscillations of the downhole system.

12. The system of claim 11, wherein the shock-damping system comprises a damper element, a shock element, and a gap comprising a gap extension defined between the shock element and the damper element.

13. The system of claim 11, wherein the downhole component comprises a longitudinal axis and a circumference in a plane perpendicular to the longitudinal axis, and the shock-damping system comprises a damper element configured to move with a relative velocity relative to the downhole component and along the circumference of the downhole component.

14. A method of damping torsional oscillations of downhole systems, the method comprising:

installing a shock-damping system at least one of on and in a downhole component located on a downhole string of the downhole system, the shock-damping system configured to reduce torsional oscillations of a downhole component by imparting a selected shock to the downhole component, wherein the torsional oscillations include a torsional oscillation mode and the shock-damping system comprises a damper element and a shock element with a gap comprising a gap extension defined between the shock element and the damper element;

calculating a size of the gap extension to reduce the torsional oscillations of the downhole system, wherein the calculated size is based on a property of the shock-damping system and an angular frequency of the torsional oscillation mode; and setting the gap extension to the calculated size.

15. The method of claim 14, wherein the property of the shock-damping system is a damper element inertia.

16. The method of claim 14, wherein the property of the shock-damping system is one of a normal force, a torque, and a friction coefficient.

17. The method of claim 14, wherein:

the calculation of the size of the gap extension is based on a shock threshold, and the shock threshold is based on a modal amplitude of the torsional oscillation mode.

18. The method of claim 14, wherein the calculation of the size of the gap extension comprises simulation of one of a disintegration device and a drill string.

19. The method of claim 14, wherein the setting of the gap extension to the calculated size is performed at one of a downhole location during a drilling operation or the earth surface.

20. The method of claim 14, wherein the calculation of the size of the gap extension is based on historical data or experimental data.

21. The method of claim 14, wherein the damper element is configured to move relative to the downhole component with a relative velocity, the method comprising generating, with imparting the selected shock, an increase of the relative velocity.

22. A method of damping torsional oscillations of downhole systems, the method comprising:

installing a shock-damping system at least one of on and in a downhole component located on a downhole string of the downhole system, the shock-damping system configured to reduce torsional oscillations of a downhole component by imparting a selected shock to the downhole component;

wherein the shock-damping system comprises a damper element arranged to move relative to the downhole component with a velocity that is a sum of a periodic velocity fluctuation having an amplitude and a mean velocity, wherein the mean velocity is lower than the amplitude of the periodic velocity fluctuation.

23. The method of claim 22, wherein the torsional oscillations include a first torsional oscillation mode, and wherein the shock-damping system includes a shock element and a gap comprising a gap extension is defined between the shock element and the damper element, wherein the selected shock is based on the gap extension and wherein a size of the gap extension is selected based on at least one of a modal amplitude of the first torsional oscillation mode and a phase of the first torsional oscillation mode.

24. The method of claim 23, wherein the torsional oscillations include a second torsional oscillation mode, wherein the size of the gap extension is selected to at least one of (i) transfer of energy between the first torsional oscillation mode and the second torsional oscillation mode, or (ii) dissipate energy from the downhole system.

* * * * *